US011230096B2

(12) United States Patent
Iwasaki et al.

(10) Patent No.: US 11,230,096 B2
(45) Date of Patent: Jan. 25, 2022

(54) PRINTING APPARATUS AND CONTROL METHOD THEREFOR

(71) Applicant: CANON KABUSHIKI KAISHA, Tokyo (JP)

(72) Inventors: Osamu Iwasaki, Tokyo (JP); Yoshinori Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/016,775

(22) Filed: Sep. 10, 2020

(65) Prior Publication Data

US 2021/0070040 A1 Mar. 11, 2021

(30) Foreign Application Priority Data

Sep. 10, 2019 (JP) ..... JP2019-164786

(51) Int. Cl.
*B41J 2/045* (2006.01)
*B41J 11/00* (2006.01)

(52) U.S. Cl.
CPC ..... *B41J 2/04566* (2013.01); *B41J 11/0022* (2021.01); *B41J 11/00242* (2021.01)

(58) Field of Classification Search
CPC ..... B41J 2/04566; B41J 11/0022; B41J 11/00242
See application file for complete search history.

(56) References Cited

U.S. PATENT DOCUMENTS 6,382,762 B1 * 5/2002 Therien ..... B41J 2/14153 324/76.14
8,955,956 B2 2/2015 Yamamoto et al.
2003/0020773 A1 * 1/2003 Schantz ..... B41J 29/393 347/14

FOREIGN PATENT DOCUMENTS

JP 2001-212952 A 8/2001
JP 2009-012414 A 1/2009

* cited by examiner

*Primary Examiner* — Justin Seo
(74) *Attorney, Agent, or Firm* — Venable LLP

(57) ABSTRACT

A printing apparatus includes a conveyance unit configured to convey a print medium, a printhead for printing an image by discharging ink to the conveyed print medium, a heating unit provided on a downstream side of the printhead with respect to a conveyance direction of the print medium and configured to heat the print medium, and a ventilation unit provided on a downstream side of the heating unit with respect to the conveyance direction and configured to ventilate air in a peripheral space of a conveyance path of the print medium. The printing apparatus controls to delay a start of printing by the printhead so that the print medium dried by the heating unit passes through the conveyance path in a state in which a humidity in the space becomes lower than a predetermined value due to the ventilation.

20 Claims, 17 Drawing Sheets

PRINTING APPARATUS AND CONTROL METHOD THEREFOR

BACKGROUND OF THE INVENTION

Field of the Invention

The present invention relates to a printing apparatus and a control method therefor, and particularly to, for example, a power suppression technique for a printing apparatus mounted with an inkjet printhead.

Description of the Related Art

Some of conventional inkjet printing apparatuses include a mechanism of drying ink discharged from a printhead to a print medium (for example, print paper). For example, Japanese Patent Laid-Open No. 2009-012414 discloses an image forming apparatus that includes, as a unit for drying ink printed on a print medium, heating rollers capable of contacting the print medium and being separated from the print medium, and a carbon heater or a halogen heater for drying ink without contacting the print medium. According to Japanese Patent Laid-Open No. 2009-012414, ink discharged to the print medium is dried by heating by controlling the operations of the heating rollers, the carbon heater or halogen heater, and the like.

However, in the conventional example, moisture contained in the print medium evaporates by heating, and the evaporated moisture increases the humidity in a conveyance path of the print medium in the printing apparatus and its peripheral space. Since a surface of the print medium, on which printing is executed by discharging ink densely, is covered with a nonvolatile solvent, a coloring material, and the like, the base material of the print medium is in a nonhygroscopic state in which it is difficult to absorb moisture in the air. On the other hand, since a surface on which no ink is discharged and printing is not executed is dried by heating to evaporate moisture from the base material of the print medium, the base material of the print medium of that surface is in a hygroscopic state in which it is easy to absorb moisture in the air.

If the print medium in this state is conveyed in a space with high humidity, a difference in expansion occurs between the base material of the printed surface and that of the non-printed surface due to moisture absorption, thereby causing deformation.

FIGS. 17A and 17B are side views of a print medium, which show a deformation state of the sheet-like print medium which has absorbed moisture. Note that in FIGS. 17A and 17B, the thickness of the print medium and the deformation of the print medium are exaggerated. FIG. 17A shows a state in which the print medium on which no printing is executed by ink discharge absorbs moisture to be deformed. FIG. 17B shows a state in which the print medium on which printing is executed by ink discharge absorbs moisture to be deformed.

If no printing is executed, the front and back surfaces of the print medium uniformly absorb moisture to expand, and the volume of the print medium increases due to expansion. However, as shown in FIG. 17A, the print medium is hardly deformed. On the other hand, if printing is executed, the printed surface has a low hygroscopic degree and the non-printed surface has a high hygroscopic degree, as described above. As a result, as shown in FIG. 17B, a state in which the non-printed surface expands due to moisture absorption and the printed surface is not expanded is obtained, and thus the print medium is curled.

The state shown in FIG. 17B occurs when printing in which an ink application amount per unit area is large is continued over a wide range on only one surface of the print medium in inkjet printing. If printing in which the ink application amount per unit area is large is continuously performed over the wide range, an amount of moisture evaporated from the print medium remains more in a conveyance path space, thereby raising the humidity in the conveyance path space. Especially, when the print medium having one surface on which printing in which the ink application amount per unit area is large is executed over a wide range passes through a conveyance path with high humidity after drying by heating, the print medium is curled with the printing surface inside. Then, if the print medium is curled, it is difficult to align the print medium appropriately when it is discharged outside the apparatus. Therefore, it becomes difficult to appropriately perform post processing such as sort processing and stapling processing for such print medium.

SUMMARY OF THE INVENTION

Accordingly, the present invention is conceived as a response to the above-described disadvantages of the conventional art.

For example, a printing apparatus and a control method therefor according to this invention are capable of suppressing occurrence of curling of a print medium after printing.

According to one aspect of the present invention, there is provided a printing apparatus comprising: a conveyance unit configured to convey a print medium fed from a feeding apparatus; a printhead configured to print an image by discharging ink to the print medium conveyed by the conveyance unit; a heating unit provided on a downstream side of the printhead with respect to a conveyance direction of the print medium and configured to heat the print medium; a ventilation unit provided on a downstream side of the heating unit with respect to the conveyance direction and configured to ventilate air in a peripheral space of a conveyance path of the print medium; and a control unit configured to control to delay a start of printing by the printhead so that the print medium dried by the heating unit passes through the conveyance path in a state in which a humidity in the space becomes lower than a predetermined value due to the ventilation by the ventilation unit.

According to another aspect of the present invention, there is provided a printing apparatus comprising: a conveyance unit configured to convey a print medium fed from a feeding apparatus; a printhead configured to print an image by discharging ink to the print medium conveyed by the conveyance unit; a heating unit provided on a downstream side of the printhead with respect to a conveyance direction of the print medium and configured to heat the print medium; a ventilation unit provided on a downstream side of the heating unit with respect to the conveyance direction and configured to ventilate air in a peripheral space of a conveyance path of the print medium; and a control unit configured to control to delay a start of conveyance by the conveyance unit so that the print medium dried by the heating unit passes through the conveyance path in a state in which a humidity in the space becomes lower than a predetermined value due to the ventilation by the ventilation unit.

According to still another aspect of the present invention, there is provided a control method for a printing apparatus including a conveyance unit configured to convey a print medium fed from a feeding apparatus, a printhead configured to print an image by discharging ink to the print medium conveyed by the conveyance unit, a heating unit provided on a downstream side of the printhead with respect to a conveyance direction of the print medium and configured to heat the print medium, and a ventilation unit provided on a downstream side of the heating unit with respect to the conveyance direction and configured to ventilate air in a peripheral space of a conveyance path of the print medium, the method comprising: controlling to delay a start of printing by the printhead so that the print medium dried by the heating unit passes through the conveyance path in a state in which a humidity in the space becomes lower than a predetermined value due to the ventilation by the ventilation unit.

The invention is particularly advantageous since it is possible to suppress occurrence of curling of a print medium after printing.

Further features of the present invention will become apparent from the following description of exemplary embodiments (with reference to the attached drawings).

DESCRIPTION OF THE EMBODIMENTS

Figure 1:
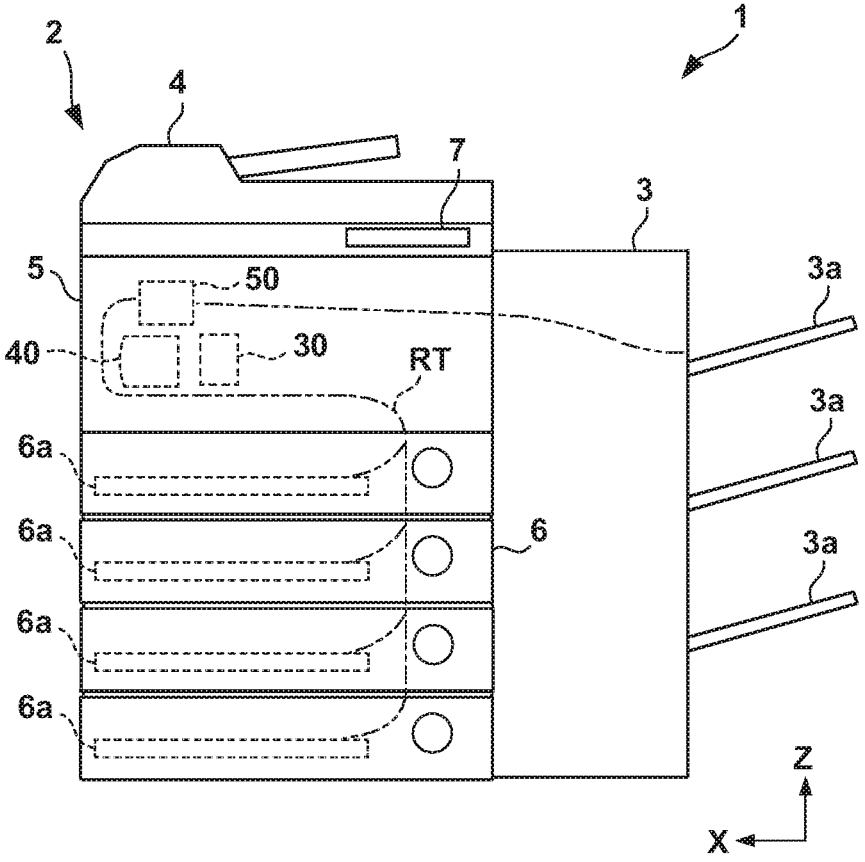
FIG. 1 is a front view of a printing system.

Exemplary embodiments of the present invention will now be described in detail in accordance with the accompanying drawings. It should be noted that the following embodiments are not intended to limit the scope of the appended claims. A plurality of features are described in the embodiments. Not all the plurality of features are necessarily essential to the present invention, and the plurality of features may arbitrarily be combined. In addition, the same reference numerals denote the same or similar parts throughout the accompanying drawings, and a repetitive description will be omitted.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, the term "nozzle" means an ink orifice or a liquid channel communicating with it, unless otherwise specified. A "print element" is provided in correspondence to an orifice, and used to mean an element for generating energy used to discharge ink. For example, the print element may be provided in a position opposite to the orifice.

An element substrate for a printhead (head substrate) used below means not merely a base made of a silicon semiconductor, but an arrangement in which elements, wirings, and the like are arranged.

Further, "on the substrate" means not merely "on an element substrate", but even "on the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

Arrangement of Printing System

FIG. 1 is a front view of a printing system 1 according to an embodiment of the present invention. In the drawings including FIG. 1, arrows X and Y indicate a horizontal direction and a depth direction, respectively, which are perpendicular to each other. An arrow Z indicates a vertical direction.

The printing system 1 includes a main body apparatus 2 and a post processing apparatus 3. The main body apparatus 2 according to this embodiment is an apparatus forming a multi-function peripheral, and has a copy function, a scanner function, and a printer function. The main body apparatus 2 includes a reading apparatus 4, a printing apparatus 5, and a feeding apparatus 6, and an operation unit 7 is provided in the front portion of the main body apparatus 2. The operation unit 7 serves as an input/output interface with a user, and includes, for example, hard keys and a display unit or a touch panel that accepts input from the user and displays information, and also includes an output unit such as a voice generator.

The reading apparatus 4 includes an ADF (Automatic Document Feeder), and conveys stacked documents and reads document images. The feeding apparatus 6 is an apparatus that feeds a print medium to the printing apparatus 5. In this embodiment, the print medium is a sheet such as paper or a film, and is particularly a cut sheet. The print medium may be referred to as a sheet hereinafter. The feeding apparatus 6 includes a plurality of cassettes 6*a* on which sheets are stacked, and a feeding mechanism (not shown) that feeds a sheet from the cassette 6*a* to the printing apparatus 5 on a conveyance path RT.

The printing apparatus 5 prints an image on the sheet. The printing apparatus 5 includes a printing unit 30 that prints an image by discharging ink to a sheet, and a first drying acceleration unit 40 and a second drying acceleration unit 50 that accelerate drying of the sheet. Details of the printing apparatus 5 will be described later.

The post processing apparatus 3 serves as a finisher (sheet processing apparatus) that is separably attached to a side portion of the main body apparatus 2 as an optional apparatus and performs post processing of the sheet. The post processing includes, for example, a stacking processing of stacking, on a tray 3*a*, a sheet discharged from the printing apparatus 5, and a sort processing of taking in a plurality of sheets discharged from the printing apparatus 5 and aligning and bundling them. The post processing can further include stapling processing of binding bundled sheets by staplers, binding processing, and punching processing.

Arrangement of Printing Apparatus

Figure 2:
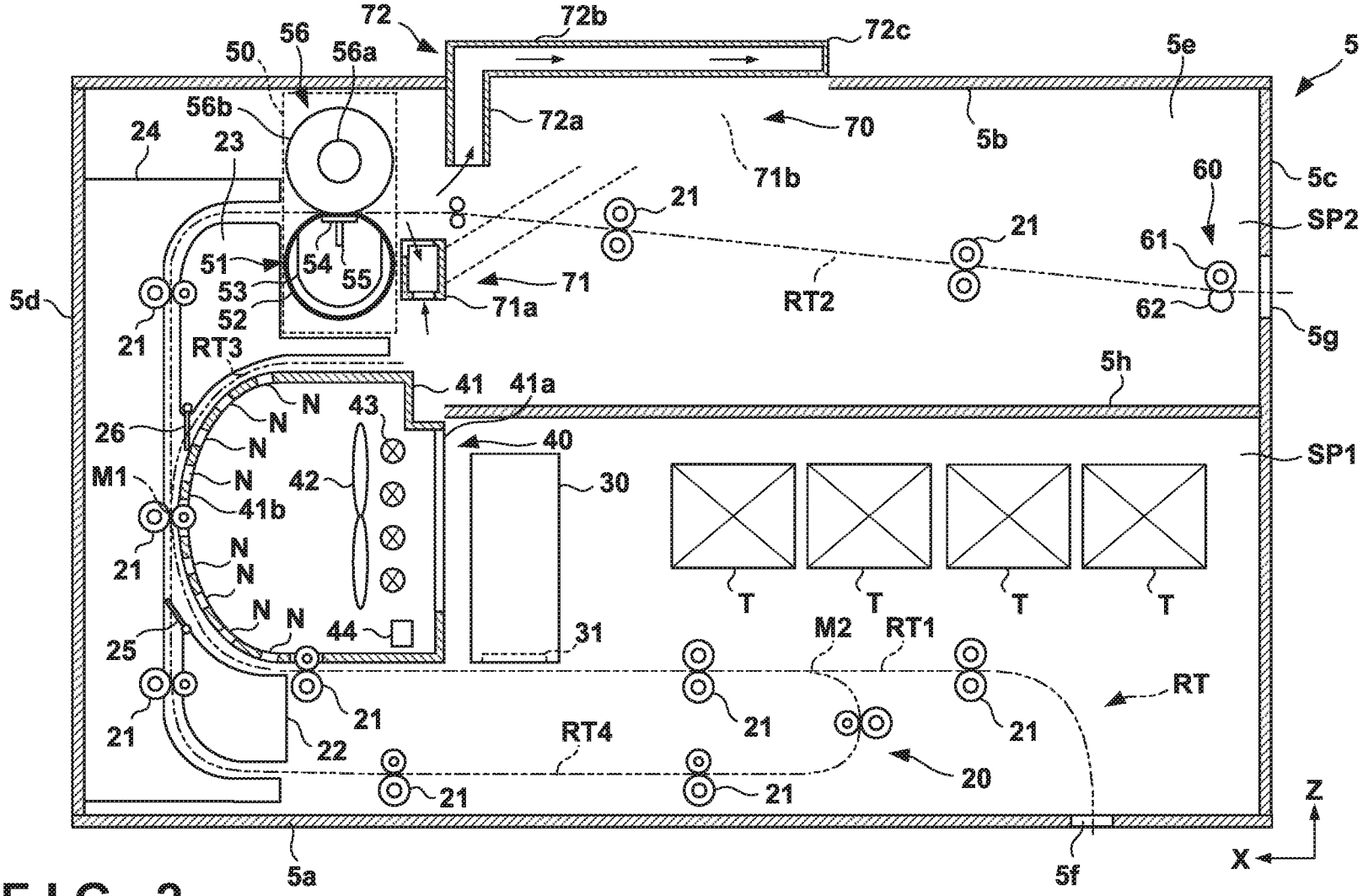
FIG. 2 is a schematic view of a printing apparatus.

FIG. 2 is an explanatory view showing the internal arrangement of the printing apparatus 5. The printing apparatus 5 includes, as a frame for supporting the internal mechanism, a bottom wall portion 5*a*, an upper wall portion 5*b*, a right wall portion 5*c*, a left wall portion 5*d*, and a back wall portion 5*e*. These wall portions define the internal space of the printing apparatus 5. The internal space of the printing apparatus 5 is divided into a lower space SP1 and an upper space SP2 by a partition wall 5*h*. The spaces SP1 and SP2 are not hermetically divided, and communicate with each other.

The bottom wall portion 5*a* includes an opening 5*f* through which a sheet fed from the feeding apparatus 6 passes. The right wall portion 5*c* includes an opening 5*g* through which a sheet passes to be discharged to the post processing apparatus 3. The left wall portion 5*d* and the right wall portion 5*c* may be supported to be opened/closed in a door type for maintenance.

The printing apparatus 5 includes a conveyance unit 20, the printing unit 30, the first drying acceleration unit 40, the second drying acceleration unit 50, a correction unit 60, and an exhaust unit 70.

Conveyance Unit

The conveyance unit 20 is a mechanism that conveys a sheet along the conveyance path RT. In this embodiment, the conveyance path RT is a path which has the opening 5*f* as an upstream end and the opening 5*g* as a downstream end and on which the sheet is conveyed. The conveyance path RT includes main paths RT1 and RT2, a switch-back path RT3, and an inverting path RT4. The main paths RT1 and RT2 are paths from the opening 5*f* to the opening 5*g* via an intermediate point M1. The main path RT1 is a path from the opening 5*f* to the intermediate point M1, and the main path RT2 is a path from the intermediate point M1 to the opening 5*g*. The main paths RT1 and RT2 are paths on which the sheet is conveyed leftward→upward→rightward, and the sheet passes through the printing unit 30→first drying acceleration unit 40→second drying acceleration unit 50→correction unit 60. For one-sided print of printing on only one surface of the sheet, the sheet is conveyed through the main paths RT1 and RT2.

The switch-back path RT3 and the inverting path RT4 are paths on which the sheet is conveyed after printing on one surface for double-sided print of printing on both surfaces of the sheet. The switch-back path RT3 forms a path from the intermediate point M1, which is different from the main path RT2. The inverting path RT4 is a path from the intermediate point M1 to a midway joining point M2 on the main path RT1. The sheet is inverted via the inverting path RT4, and is returned to the main path RT1 again.

When referring to the downstream side and the upstream side in the following description, the conveyance direction of the sheet on the conveyance path RT is set as a reference.

The conveyance unit 20 includes a driving mechanism that applies a conveying force to the sheet, and a guide that guides conveyance of the sheet along the conveyance path RT, and FIG. 2 shows part of the conveyance unit 20. The driving mechanism includes a plurality of conveyance rollers 21 driven by a driving source such as a motor. For each conveyance roller 21, a driven roller or a spur is arranged to face it. The sheet is conveyed while being nipped between each conveyance roller 21 and its corresponding driven roller or spur. The spur is arranged to contact a printing surface in a region on the downstream side with respect to the printing unit 30 in order to maintain the quality of a printed image. The guide includes guide members 22 to 24. The guide member 24 is supported by the left wall portion 5*d*. Part of the conveyance path RT is formed between the guide members 23 and 24 and part of the main path RT1 is formed between the guide members 22 and 24.

Figure 3:
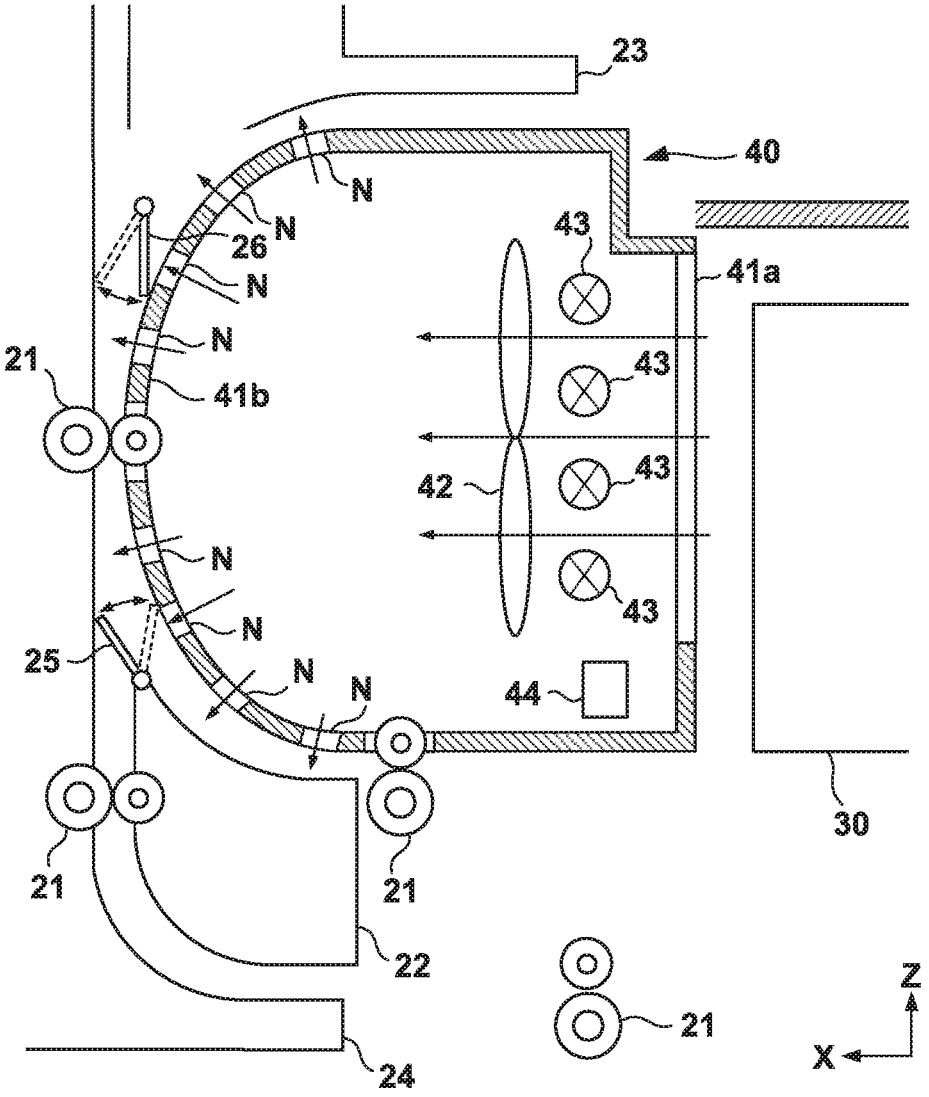
FIG. 3 is an explanatory view of a drying acceleration unit.

The conveyance unit 20 includes path switching units 25 and 26. The path switching units 25 and 26 are units that switch the guiding path of the sheet, and are operated by a driving source such as an electromagnetic solenoid or a motor. For one-sided print, the path switching units 25 and 26 guide the sheet from the main path RT1 to the main path RT2. For double-sided print, the path switching units 25 and 26 guide the sheet from the main path RT1 to the switch-back path RT3, and guide the switched-back sheet to the inverting path RT4. FIG. 3 shows the path switching mode of the path switching units 25 and 26. The path switching units 25 and 26 each include a pivotable flap, and switch the path by the positions of the flaps. The positions indicated by solid lines are those for one-sided print, and the positions indicated by broken lines are those for double-sided print.

Printing Unit

Referring back to FIG. 2, the printing unit 30 includes printheads 31, and each printhead 31 is an inkjet head that forms an image (ink image) by discharging ink to a sheet. Inks to be discharged by the printheads 31 are stored in a plurality of ink reservoirs T. The ink reservoirs T are provided for the respective kinds of inks. The kinds of inks are, for example, yellow, magenta, cyan, and black as kinds of colors.

The printheads 31 are provided for the respective kinds of inks. In this embodiment, each printhead 31 is a full-line head extended in the Y direction, and nozzles are arrayed within a range where they cover the width of an image printing area of a sheet having a usable maximum size. Each printhead includes a lower surface facing the sheet via a minute gap (for example, several mm), and the lower surface forms an ink discharge surface with the opened nozzle.

Each nozzle includes a discharge element. The discharge element is, for example, an element that generates a pressure in the nozzle and discharges ink in the nozzle, and the technique of a known inkjet head is applicable. Examples of the discharge element are an element that discharges ink by causing film boiling in ink with an electrothermal transducer and forming a bubble, an element that discharges ink by an electromechanical transducer, and an element that discharges ink by using static electricity. The discharge element that uses the electrothermal transducer can be used to perform high-speed and high-density printing.

Note that the printing unit 30 may be a serial-type printing unit in which printheads mounted on a carriage execute printing by reciprocally moving in the width direction of a sheet. The number of kinds of discharged inks may be one, for example, only black ink may be discharged. As the print mode of the printing unit 30, a print mode of using a single ink or a print mode of using a plurality of kinds of inks can be selected. Each ink may mainly contain a coloring material (dye or pigment) and a solvent component. As a solvent component, a water-based material can be used. As a dye, for example, a water-soluble dye represented by a direct dye, an acid dye, a basic dye, a reactive dye, an edible pigment, or the like is preferable. However, any dye may be used as long as an image that satisfies a fixing property, color development, sharpness, stability, light resistance, and other required properties in combination of the print medium is obtained. As a pigment, carbon black or the like is preferable. Any of a method using a pigment and a dispersant, a method using a self-dispersion type pigment, and a method of performing microencapsulation can be used. Furthermore, ink can be used by adding, as appropriate, various additives such as a solvent component, a solubilizer, a viscosity modifier, a surfactant, a surface tension regulator, a pH adjuster, and a resistivity modifier.

Drying Acceleration Unit

A sheet on which an image has been printed by the printing unit 30 may be expanded due to the liquid of the ink, and may be waved. Such sheet causes a paper jam in the printing apparatus 5 or degrades stackability/alignment in the post processing apparatus 3. By accelerating drying of the sheet, it is possible to suppress expansion of the sheet caused by the liquid of the ink. The printing apparatus 5 according to this embodiment includes the plurality of drying acceleration units, that is, the first drying acceleration unit 40 and the second drying acceleration unit 50 of different sheet drying methods.

The first drying acceleration unit 40 is a unit that is arranged on the downstream side with respect to the printing unit 30 and accelerates drying of the sheet by blowing warm air (e.g. air at a temperature of 30° C. to 100° C.) to the sheet without contacting the sheet. The structure of the first drying acceleration unit 40 will be described with reference to FIGS. 2 and 3.

The first drying acceleration unit 40 includes a hollow body 41 that defines the internal space, and a fan 42 and heating elements 43 all of which are arranged in the hollow body 41. The hollow body 41 includes an air intake port 41*a* in a right portion. A wall portion 41*b* that forms the left portion of the hollow body 41 is a guide wall portion also serving as a sheet conveyance guide, and is extended in the Y direction to cover the width of a sheet having the maximum size. The guide wall portion 41*b* has a C-shaped sectional shape (a section on an X-Z plane), and includes a wall surface facing the guide members 22 to 24. Part of the conveyance path RT is formed between the wall surface and the guide members 22 to 24, and the intermediate point M1 is also set. In the guide wall portion 41*b*, a number of warm air blowing holes N communicating with the internal space of the hollow body 41 are formed.

The fan 42 is an electric fan that uses a motor as a driving source, and is, for example, a sirocco fan. The fan 42 introduces air from the air intake port 41*a* into the hollow body 41. The pressure in the hollow body 41 increases by the introduced air, and the air in the hollow body 41 is blown out of the hollow body 41 from the blowing holes N. One fan 42 may be provided or a plurality of fans 42 may be juxtaposed in the Y direction.

The heating elements 43 heat the air introduced by the fan 42 from the air intake port 41*a* into the hollow body 41. In this embodiment, each heating element 43 is a rod-like heating element such as an infrared lamp heater, and is extended in the Y direction. The plurality of heating elements 43 are arrayed in the Z direction. The plurality of heating elements 43 are arranged between the fan 42 and the air intake port 41*a*, and the air introduced from the air intake port 41*a* into the hollow body 41 is heated when it passes through the heating elements 43. A temperature sensor 44 is provided in the first drying acceleration unit 40, and driving of the heating elements 43 is controlled in accordance with the detection result of the temperature sensor 44.

With this arrangement, the first drying acceleration unit 40 blows warm air from the blowing holes N, as indicated by an airflow represented by arrows in FIG. 3. This can heat the sheet passing through the conveyance path RT, and promote evaporation of a liquid contained in the ink image on the sheet, thereby accelerating drying of the sheet.

The second drying acceleration unit 50 is a thermal fixing unit that is arranged on the downstream side with respect to the first drying acceleration unit 40 and accelerates drying of the sheet by heating the sheet in contact with the image printing surface of the sheet. The structure of the second drying acceleration unit 50 will be described with reference to FIG. 2.

The second drying acceleration unit 50 includes a heater 51 and a roller 56, which are extended in the Y direction to cover the width of a sheet having the maximum size. The heater 51 includes a support member 53 that supports a heating element 54. The heating element 54 is, for example, a ceramic heater, and is extended in the Y direction. The temperature of the heating element 54 is detected by a temperature sensor 55 represented by a thermistor, and driving of the heating element 54 is controlled based on a detection result.

The support member 53 also supports a film 52. The film 52 is formed in a cylindrical shape and extended in the Y direction. The film 52 is supported by the support member 53 to be rotatable about the support member 53, and is interposed between the roller 56 and the heating element 54. The film 52 is, for example, a single-layer film or composite layer film having a film thickness of 10 μm (inclusive) to 100 μm (inclusive). When the film 52 is a single-layer film, for example, PTFE, PFA, or FEP is used as a material. When the film 52 is a composite film, for example, it is a film with a layer structure that covers or coats a layer of polyimide, polyamide-imide, PEEK, PES, PPS, or the like with PTFE, PFA, FEP, or the like.

Note that the arrangement of the heater 51 is not limited to this, and may have, for example, a structure that includes a heating element such as a halogen heater in a hollow metal core and covers the periphery of the core with an elastic body such as a silicone rubber.

The roller 56 is formed by covering the periphery of a core 56*a* with an elastic body 56*b* such as a silicone rubber. The roller 56 is pressed against the heater 51 by a predetermined pressing force, and the roller 56 and the heater 51 form a nip portion. The roller 56 is rotated using a motor as a driving source, and the film 52 rotates together with the roller 56. With this arrangement, the sheet is heated while being conveyed in the nip portion, thereby making it possible to accelerate drying of the sheet.

In this embodiment, the first drying acceleration unit 40 and the second drying acceleration unit 50 dry the sheet in two stages. However, only one of the drying acceleration units may be provided.

Correction Unit

The correction unit 60 is a mechanism that corrects the curvature (curl in this example) of a sheet. In this embodiment, the correction unit 60 includes a large-diameter driving roller 61 and a small-diameter driven roller 62. The driving roller 61 is a roller obtained by covering the periphery of a core with an elastic body such as a silicone rubber. The driven roller 62 is a metal roller. The driving roller 61 and the driven roller 62 are in press contact with each other. When a sheet passes between the driving roller 61 and the driven roller 62, these rollers can apply a pressure to the sheet to correct the curl of the sheet. The correction unit 60 can apply, to the sheet, a correction force in, for example, an upwardly-convex direction. In this case, the correction unit 60 can correct a sheet having a downwardly-convex curl to a flatter state.

Exhaust Unit

The exhaust unit 70 is a unit that exhausts the air in the printing apparatus 5 outside the apparatus. The printing apparatus 5 according to this embodiment includes the first drying acceleration unit 40 and the second drying acceleration unit 50, which raise the temperature in the apparatus. In addition, these units operate to evaporate moisture of ink. When continuously printing on a number of sheets, the humidity in the apparatus may rise. A high humidity causes the sheet to be curved. The conveyance distance of the sheet from the second drying acceleration unit 50 to the opening 5*g* is relatively long, and the sheet is conveyed within the upper space SP2 where water vapor is readily retained. In the space SP2, the sheet may be exposed to a high-humidity atmosphere. The humidity in the apparatus can be lowered when the exhaust unit 70 exhausts the air in the space SP2 outside the apparatus.

Figure 4:
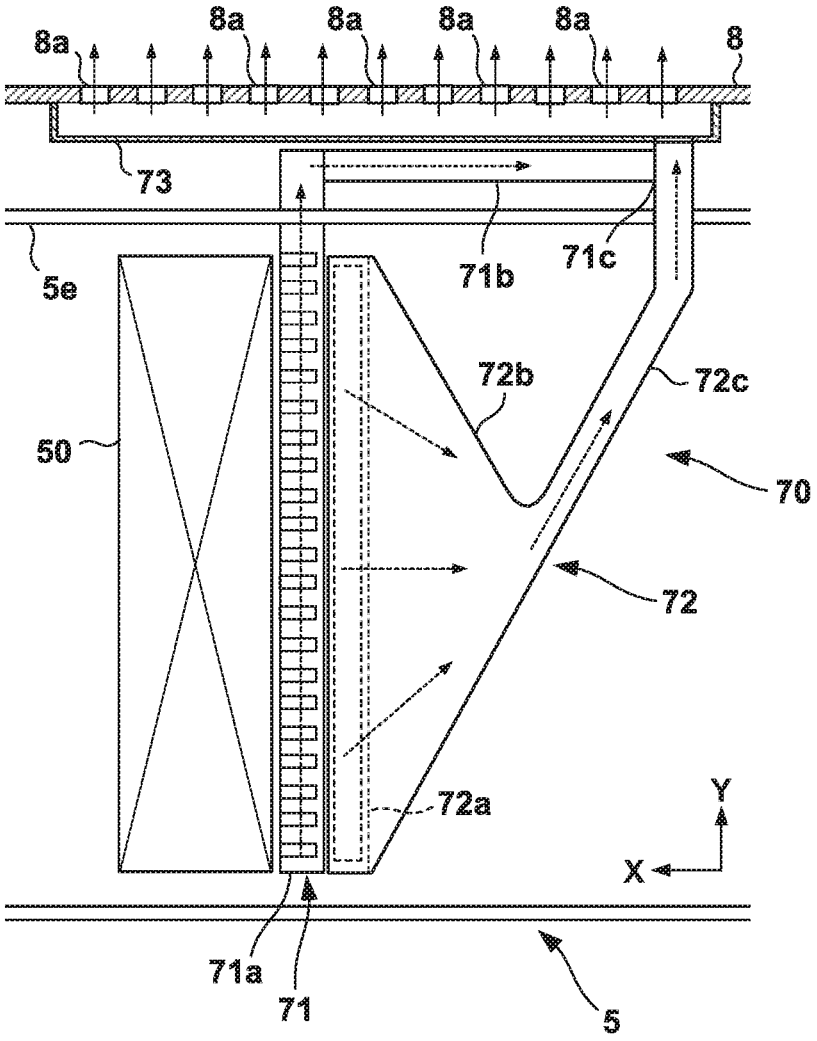
FIG. 4 is an explanatory view of an exhaust unit.

The exhaust unit 70 according to this embodiment has a structure that naturally exhausts the air in the space SP2 by a plurality of exhaust ducts 71 to 73. However, the exhaust unit 70 may forcibly exhaust the air in the apparatus by a fan or the like. The structure of the exhaust unit 70 will be described with reference to FIGS. 2 to 4. FIG. 4 is a plan view showing the periphery of the exhaust unit 70, and does not illustrate the upper wall portion 5*b*.

The exhaust duct 71 is a tube member including an extended portion 71*a* extended in the Y direction and an extended portion 71*b* extended from the far end portion in the Y direction of the extended portion 71*a* to the right side in the X direction. The extended portion 71*a* is extended at a position lower than the main path RT2 near a sheet discharge position in the second drying acceleration unit 50. The extended portion 71*a* is an air intake portion in which a plurality of slits serving as air intake ports are formed in the upper left portion and the bottom portion. For example, air warmed by the second drying acceleration unit 50 can be introduced from the slit in the upper left portion, and warm air blown from the blowing holes N of the first drying acceleration unit 40 can be introduced from the slit in the bottom portion. The extended portion 71*a* is extended across the back wall portion 5*e*, and the far end portions in the Y direction of the extended portion 71*a* and the extended portion 71*b* are located outside (on the far side in the Y direction of) the space SP2. Note that the extended portion 71*a* may be extended at a position above the main path RT2.

The exhaust duct 72 is a tube member including an extended portion 72*a* extended in the Y direction, a collecting portion 72*b* extending rightward from the extended portion 72*a*, and an extended portion 72*c* extended from the right end portion of the collecting portion 72*b* to the far side in the Y direction. The extended portion 72*a* is extended at a position above the main path RT2 near the sheet discharge position in the second drying acceleration unit 50. The bottom portion of the extended portion 72*a* is open to form an air intake port from which, for example, air warmed by the second drying acceleration unit 50 or water vapor in the space SP2 is introduced. The extended portion 72*a* protrudes above the upper wall portion 5*b* across the upper wall portion 5*b*.

The collecting portion 72*b* has, in a planar view, a triangular shape which is wide on the side of the extended portion 72*a*, and the overall collecting portion 72*b* is located above the upper wall portion 5*b*. The collecting portion 72*b* collects, to the central portion in the Y direction in the right end portion, the air introduced into the extended portion 72*a*. The collected air flows into the extended portion 72*c*. The overall extended portion 72*c* is also located above the upper wall portion 5*b*, and the extended portion 72*c* is partially bent and extended on the far side of the back wall portion 5*e*. On the far side of the back wall portion 5*e*, the extended portion 71*b* of the exhaust duct 71 is connected to the extended portion 72*c* of the exhaust duct 72, and the internal spaces of these portions communicate with each other. The extended portion 72*c* is connected to the exhaust duct 73.

The exhaust duct 73 is an exhaust member that is extended in the X direction and is open to the far side in the Y direction. The opening of the exhaust duct 73 faces a cover 8 that forms the exterior of the main body apparatus 2 on the back side. In the cover 8, a number of slits (louvers) 8*a* are formed, and the air flowing into the exhaust duct 73 is exhausted out of the apparatus from the back side of the main body apparatus 2 through the slits 8*a*.

Control Unit

Figure 5:
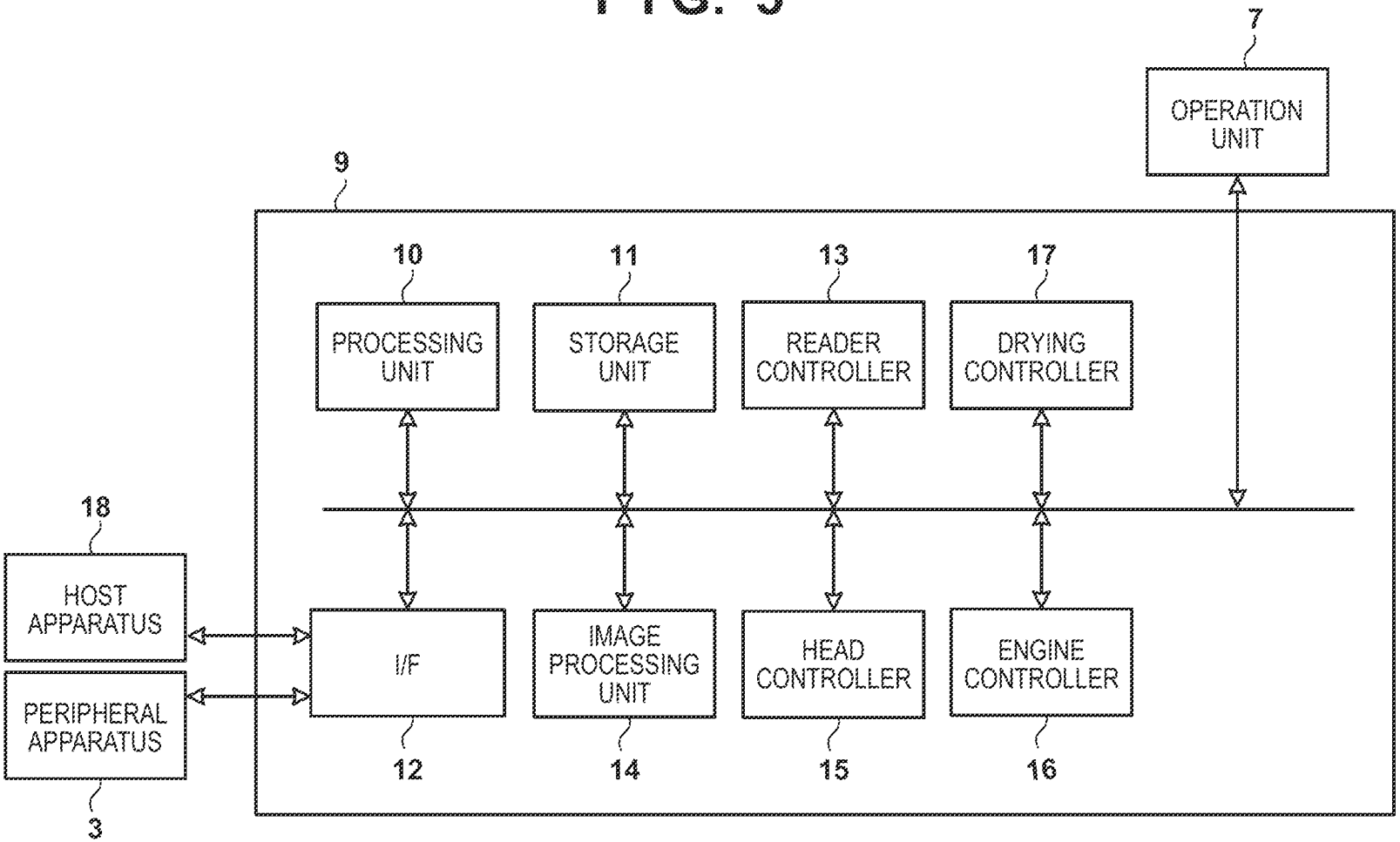
FIG. 5 is a block diagram of a control unit of a main body apparatus.

The control system of the main body apparatus 2 will be described. FIG. 5 is a block diagram of a control unit 9 of the main body apparatus 2. The control unit 9 includes a processing unit 10, a storage unit 11, a reading controller 13, an image processing unit 14, a head controller 15, an engine controller 16, and a drying controller 17. The processing unit 10 is a processor represented by a CPU (Central Processing Unit), and comprehensively controls the operations of the units of the main body apparatus 2. The storage unit 11 is, for example, a storage device such as a ROM or a RAM. The storage unit 11 stores a program to be executed by the processing unit 10, and permanent data (for example, data concerning a sheet type stored in each cassette 6*a*) necessary for various operations of the main body apparatus 2. The storage unit 11 serves as a work area of the processing unit 10 or a temporary storage area of various reception data to store various setting data.

The reading controller 13 controls the reading apparatus 4. The image processing unit 14 performs image processing of image data to be processed by the main body apparatus 2. The color space (for example, YCbCr) of input image data is converted into a standard RGB color space (for example, sRGB). Print data obtained by these image processes is stored in the storage unit 11. The head controller 15 controls driving of the printing unit 30 in accordance with the print data based on a control command received from the processing unit 10. The engine controller 16 controls conveyance of a sheet. The drying controller 17 controls driving of the first drying acceleration unit 40 and the second drying acceleration unit 50. Each of these controllers includes a processor such as a CPU, a storage device such as a RAM or a ROM, and an interface with an external device.

An I/O 12 is an interface (I/F) for connecting the control unit 9 to a host apparatus 18 and the post processing apparatus 3, and is a local I/F or a network I/F. The host apparatus 18 is an apparatus serving as a supply source of image data for causing the printing apparatus 5 to perform a printing operation. The host apparatus 18 may be a general-purpose or dedicated computer, or a dedicated image apparatus including an image reader, such as an image capture device, a digital camera, or a photo storage.

Operation Example

An example of the printing operation of the printing apparatus 5 under the control of the control unit 9 will be described with reference to FIGS. 6 to 9. First, an operation when printing an image on one surface of a sheet will be described with reference to FIGS. 6 and 7. When printing an image on one surface of a sheet, the path switching units 25 and 26 are set at the positions (the positions indicated by solid lines in FIG. 3) for one-sided print. The heating elements 43 of the first drying acceleration unit 40 and the heating element 54 of the second drying acceleration unit 50 are maintained in advance at a predetermined temperature.

Figure 6:
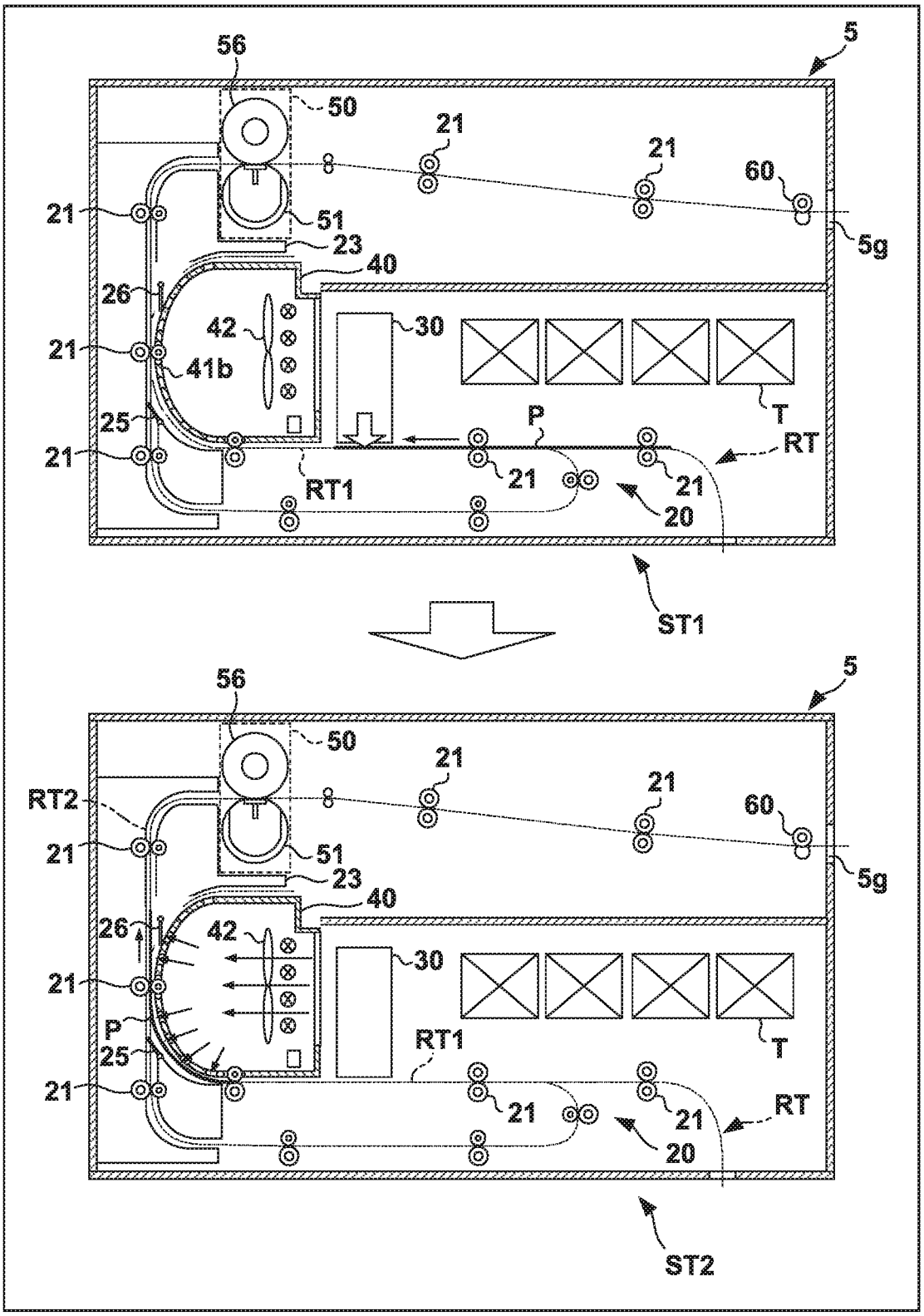
FIG. 6 is an explanatory view of the operation of the printing apparatus shown in FIG. 2.

A state ST1 shown in FIG. 6 indicates a state in which a sheet P fed from the feeding apparatus 6 has been conveyed by the conveyance unit 20 to the printing unit 30 on the main path RT1, and printing by the printing unit 30 has started. The printing unit 30 prints an image by discharging ink to the sheet P as indicated by an arrow. The sheet P is conveyed toward the first drying acceleration unit 40. The first drying acceleration unit 40 starts to operate, and blows warm air to the conveyed sheet P, as indicated by a state ST2 shown in FIG. 6. The warm air accelerates drying of the sheet P wet with ink.

The sheet P is further conveyed toward the second drying acceleration unit 50 on the main path RT2. The second drying acceleration unit 50 starts to operate, the roller 56 rotates, as indicated by a state ST3 shown in FIG. 7, and the sheet P is heated by the heater 51 while being conveyed. Drying of the sheet P is further accelerated.

Figure 7:
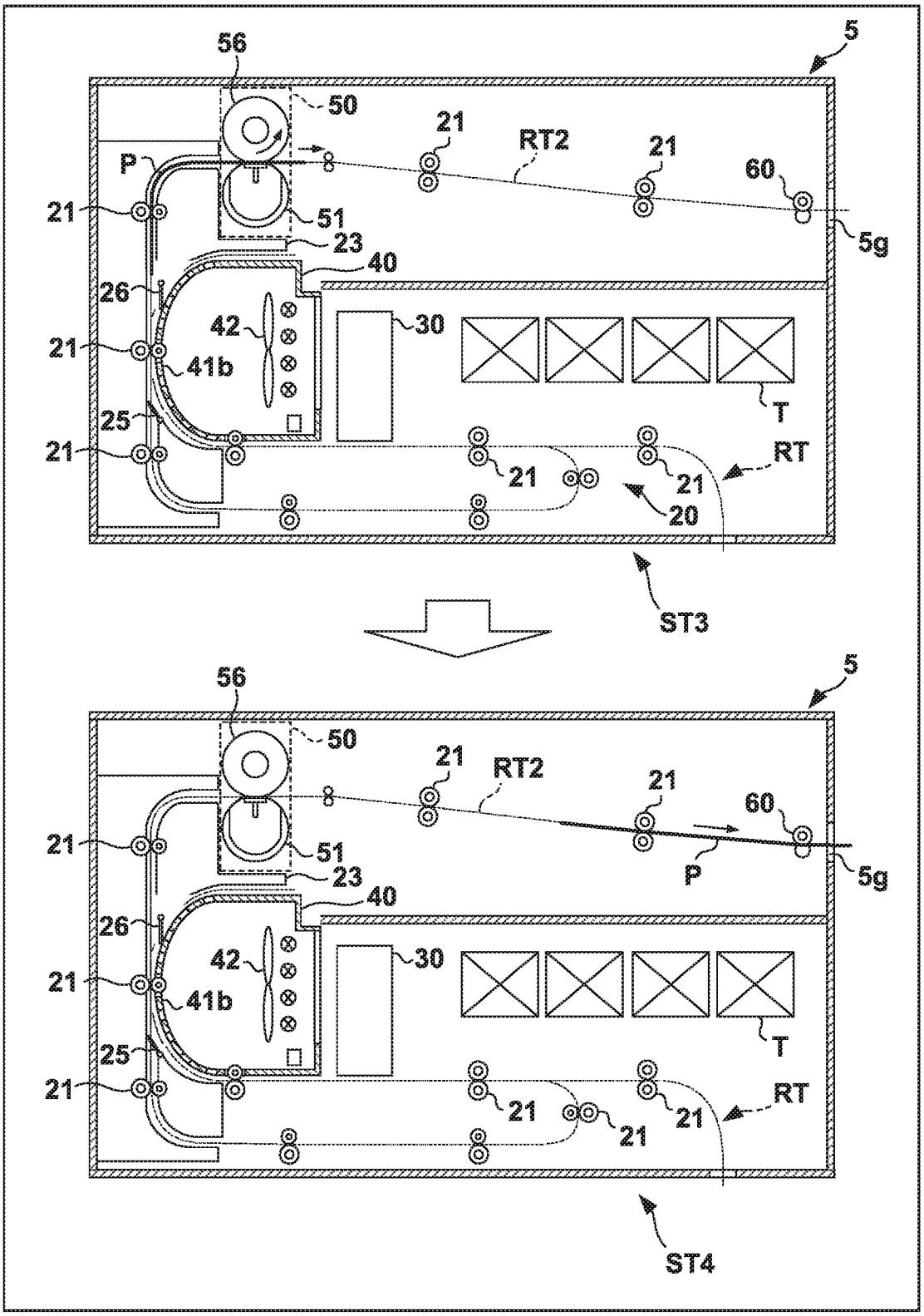
FIG. 7 is an explanatory view of the operation of the printing apparatus shown in FIG. 2.

As indicated by a state ST4 shown in FIG. 7, the sheet P is further conveyed toward the correction unit 60 on the main path RT2. The correction unit 60 starts to operate, and the sheet P is discharged from the opening 5*g* to the post processing apparatus 3 while the curl of the sheet P is corrected.

Figure 8:
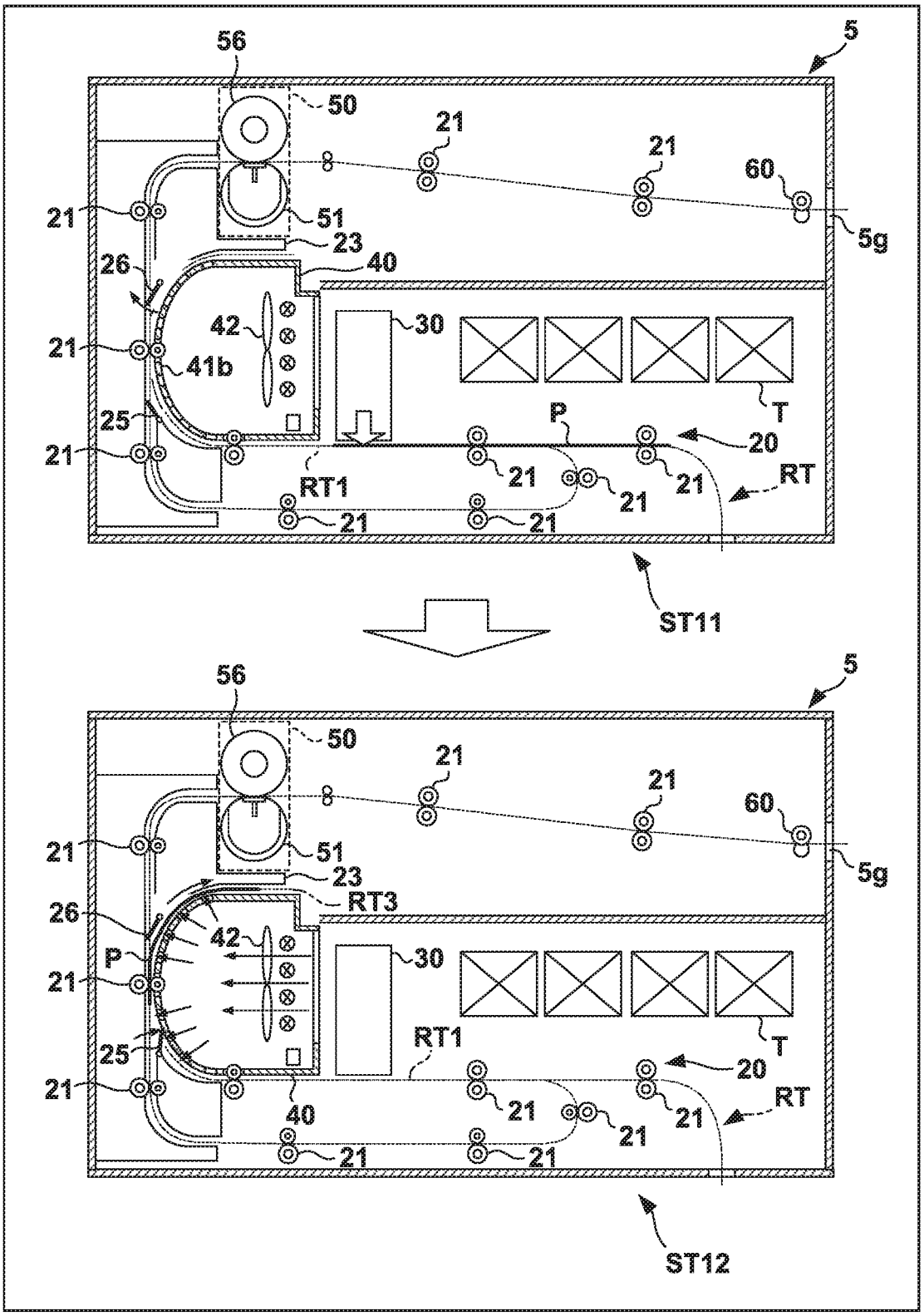
FIG. 8 is an explanatory view of the operation of the printing apparatus shown in FIG. 2.

An operation when printing images on both surfaces of a sheet will be described next with reference to FIGS. 8 and 9. A state ST11 shown in FIG. 8 indicates a state in which the sheet P fed from the feeding apparatus 6 has been conveyed by the conveyance unit 20 to the printing unit 30 on the main path RT1, and the printing unit 30 has started printing. The printing unit 30 prints an image by discharging ink to the front surface of the sheet P, as indicated by an arrow. The path switching unit 26 is set at the position (the position indicated by the broken line in FIG. 3) for double-sided print.

The sheet P is conveyed toward the first drying acceleration unit 40. The first drying acceleration unit 40 starts to operate, and blows warm air to the conveyed sheet P, as indicated by a state ST12 shown in FIG. 8. The warm air accelerates drying of the sheet P wet with ink. The path switching unit 26 guides the sheet P not to be conveyed to the second drying acceleration unit 50 but to be conveyed to the switch-back path RT3. When the trailing edge of the sheet P passes through the position of the path switching unit 25, the path switching unit 25 is set at the position for double-sided print. Subsequently, the conveyance unit 20 conveys the sheet P in a reverse direction on the switch-back path RT3 (switch-back conveyance).

Figure 9:
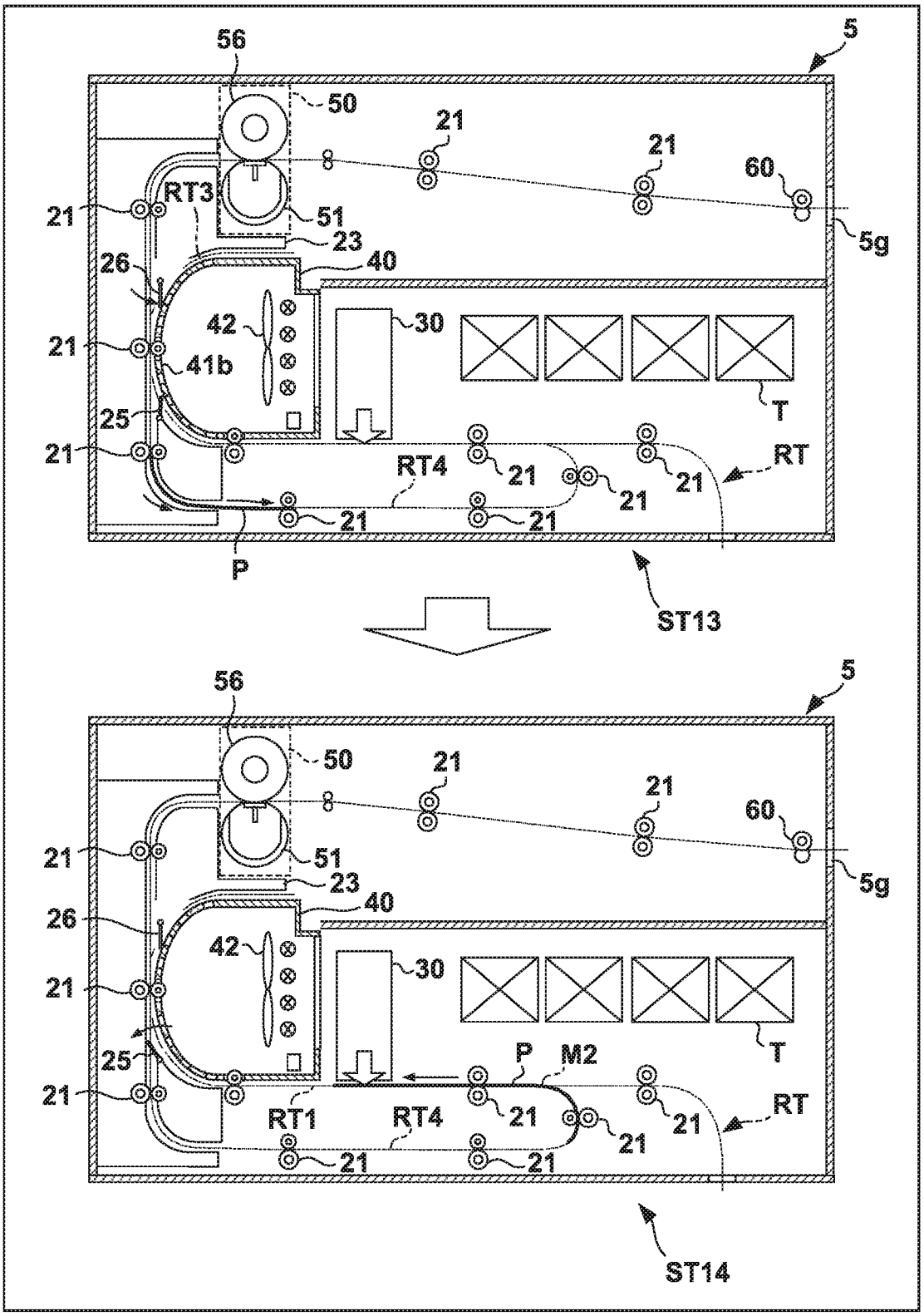
FIG. 9 is an explanatory view of the operation of the printing apparatus shown in FIG. 2.

The path switching unit 25 guides the sheet P to be conveyed to the inverting path RT4, as indicated by a state ST13 shown in FIG. 9. Then, the sheet P is returned to the main path RT1, as indicated by a state ST14 shown in FIG. 9. The path switching unit 25 is set at the position (the position indicated by the solid line in FIG. 3) for one-sided print. The printing unit 30 prints an image by discharging ink to the back surface of the sheet P, as indicated by an arrow. Operations after that are the same as those in the states ST2 to ST4 for one-sided print.

Some embodiments of drying, by heating a print medium after printing in the printing system with the above arrangement will be described next.

First Embodiment

Figure 10:
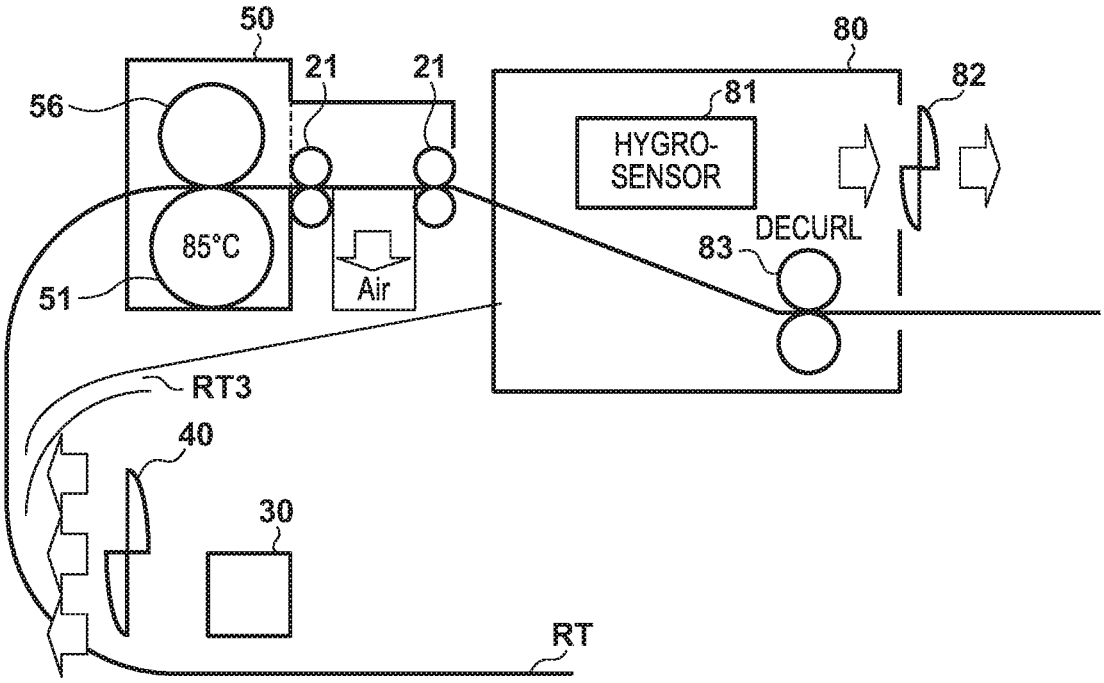
FIG. 10 is a schematic side sectional view obtained by extracting only characteristic components according to the first embodiment from the printing system shown in FIGS. 1 to 9.

FIG. 10 is a schematic side sectional view obtained by extracting only characteristic components according to this example from the printing system with the above arrangement.

As described above, a print medium on which an image is formed is conveyed along the conveyance path RT, and dried by heating by the second drying acceleration unit 50. Then, moist air is discharged from an opening formed in the printing apparatus 5 by natural ventilation from a portion between the two conveyance rollers 21 provided just on the downstream side of the second drying acceleration unit 50 with respect to the conveyance direction of the print medium. However, if high-duty printing is executed and an ink discharge amount per unit area of the print medium is large, such natural ventilation does not suffice, and moist air may still remain in the peripheral space of the conveyance path RT.

In this embodiment, to exhaust such moist air, an arrangement in which an enclosure 80 is provided in a space on the downstream side of the second drying acceleration unit 50 with respect to the conveyance direction of the print medium and air in the space is discharged outside the apparatus, as shown in FIG. 10, is adopted. More specifically, in the enclosure 80, a hygro-sensor 81 and a fan 82 for ventilating air so that the humidity (RH) of the air in the internal space becomes lower than a predetermined humidity are provided. Furthermore, a decurling roller 83 for decurling the curled print medium is provided on the conveyance path RT in the internal space.

Humidity information from the hygro-sensor 81 is output to the drying controller 17 of the control unit 9, and the drying controller 17 controls the operation of the fan 82 based on the humidity information. Furthermore, the head controller 15 and the engine controller 16 delay the conveyance timing and the print timing of the print medium so that the print medium is conveyed in a state in which the humidity in the internal space of the enclosure 80 becomes lower than the predetermined humidity under the control of the drying controller 17. In other words, a wait time until an appropriate humidity is reached is provided for conveyance and printing executed at predetermined timings when continuously feeding print media.

Note that the remaining components in FIG. 10 are the same as those described with reference to FIGS. 1 to 9 and are thus denoted by the same reference numerals, and a description thereof will be omitted.

Control of drying, by heating, the print medium after printing according to this embodiment will be described next with reference to flowcharts.

Figure 11:
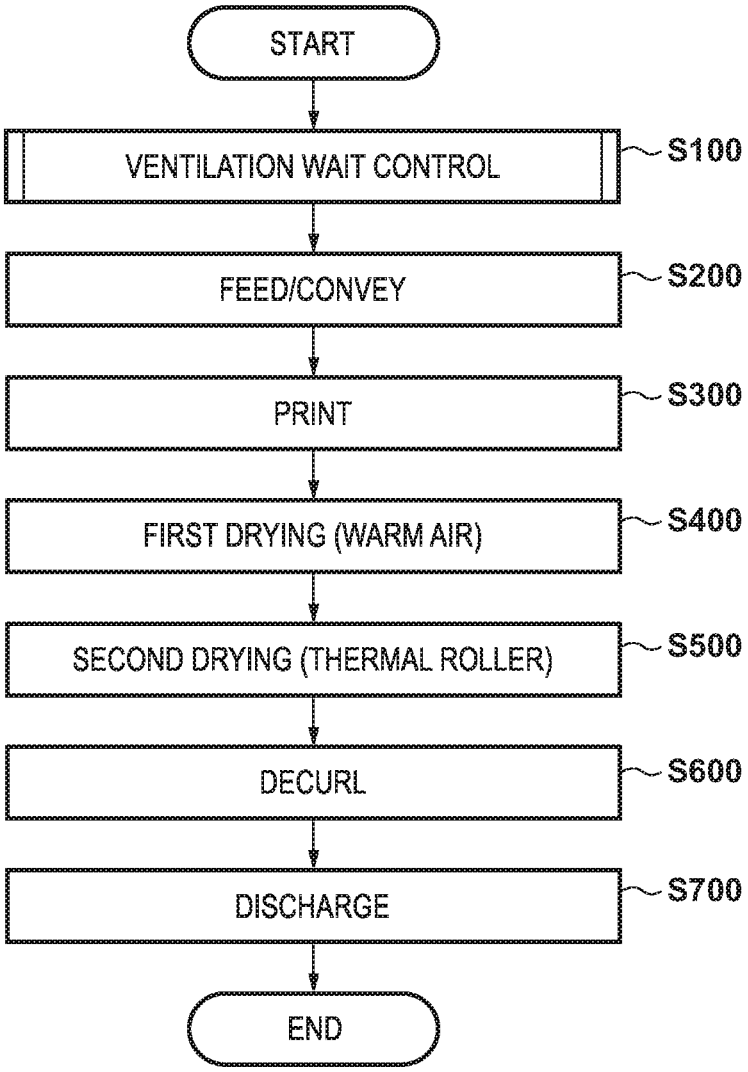
FIG. 11 is a flowchart illustrating print control according to the first embodiment.
Figure 12:
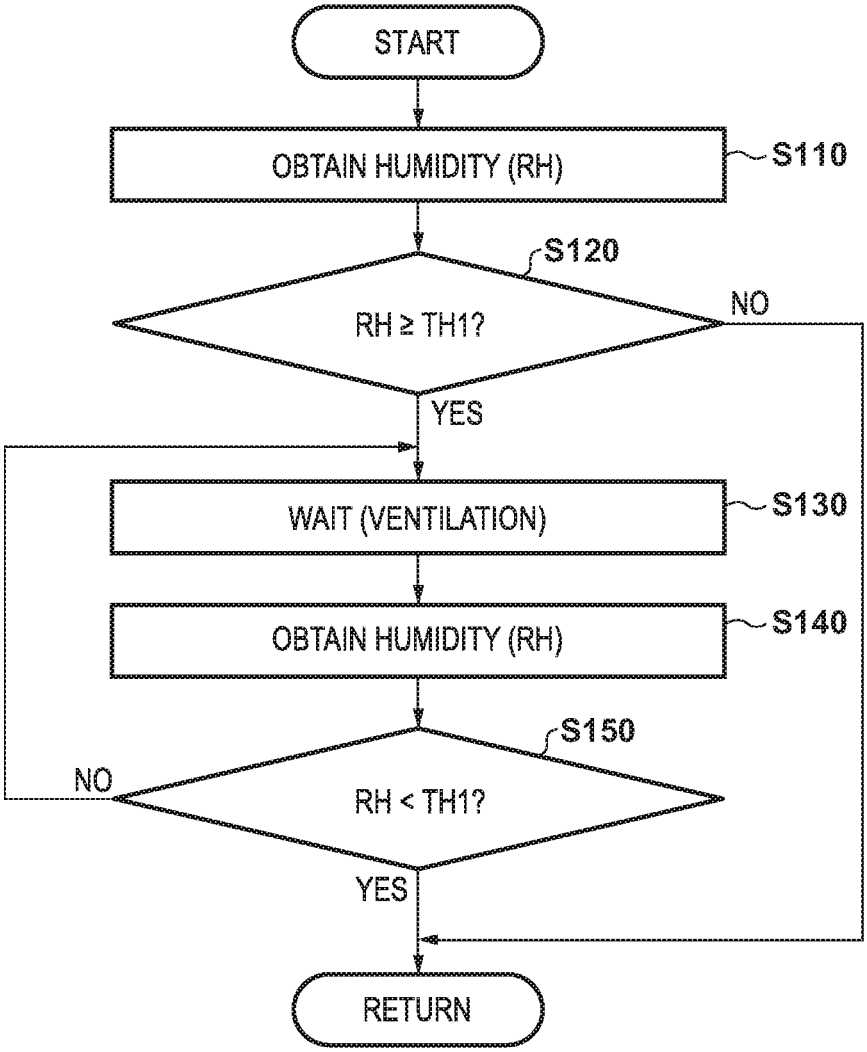
FIG. 12 is a flowchart illustrating details of ventilation control included in the print control shown in FIG. 11.

FIG. 11 is a flowchart illustrating print control according to the first embodiment. FIG. 12 is a flowchart illustrating details of ventilation wait control (ventilation control) included in the print control shown in FIG. 11.

Referring to FIG. 11, before a printing operation, in step S100 the interior of the enclosure 80 is ventilated so that the humidity (RH) of the air in the enclosure 80 becomes lower than the predetermined humidity, and the printing operation is made to stand by until this processing ends. This will be referred to as ventilation wait control hereinafter.

Referring to FIG. 12, in the ventilation wait control, in step S110, the humidity (RH) measured by the hygro-sensor 81 is acquired. In step S120, the acquired humidity (RH) is compared with a predetermined threshold (TH1). If the acquired humidity (RH) is equal to or higher than the threshold (RH≥TH1), the process advances to step S130; otherwise (RH<TH1), the ventilation wait control ends.

In step S130, the fan 82 is operated to ventilate the internal space of the enclosure 80. During ventilation, the process stands by without performing the printing operation. Furthermore, in step S140, the humidity (RH) measured by the hygro-sensor 81 again is acquired. In step S150, the acquired humidity (RH) is compared with the predetermined threshold (TH1). If the acquired humidity (RH) is still equal to or higher than the threshold (RH≥TH1), the process returns to step S130; otherwise (RH<TH1), the ventilation wait control ends.

As described above, ventilation by the fan 82 is continued until it is determined that the humidity in the internal space of the enclosure 80 is lower than the predetermined threshold, and the printing operation stands by during this period. Then, if it is determined that the humidity in the internal space of the enclosure 80 is lower than the predetermined threshold, the process advances to step S200.

Note that the predetermined threshold (TH1) indicates a humidity that satisfies a condition that deformation caused by a difference in swell between the base materials of the front and back surfaces of the print medium is smaller than a predetermined amount.

Referring back to FIG. 11, in step S200, the print medium is fed/conveyed. If the continuously fed next print medium stands by (stops) before the printheads 31 for the ventilation wait control, conveyance of the print medium is restarted to convey the print medium to the printheads 31. Alternatively, if the next print medium is not fed, the print medium stacked on the cassette 6*a* of the feeding apparatus 6 is picked up by the pickup rollers, fed to the conveyance path RT, and further conveyed by the conveyance rollers 21 to the printheads 31.

When this control creates a delay in printing and conveyance for ventilation of the conveyance path before the start of printing on each print medium, the print medium on which the image is printed can pass through the conveyance path on which the humidity is lower than the desired humidity. Note that if the continuous feed speed is high, a method of delaying pickup of the print medium by the pickup rollers may be adopted. That is, a mode of delaying the feed timing also produces the same effect.

If the print medium is conveyed to reach the printing area of the printheads 31, the printheads 31 discharge ink to print the image in step S300. The print medium on which the image is printed is conveyed toward the first drying acceleration unit 40. At this time, in step S400, the fan 42 and the heating element 43 of the first drying acceleration unit 40 are driven to dry the printing surface of the print medium by warm air blown from the blowing holes N. Furthermore, the print medium is conveyed on the conveyance path RT to reach the second drying acceleration unit 50.

In step S500, the heating element 54 of the heater 51 is driven to heat the roller 56 of the second drying acceleration unit 50, and the conveyed print medium is dried by heating, thereby fixing the image on the print medium. The print medium is further conveyed on the conveyance path RT to reach the enclosure 80. Note that at this time, the humidity in the internal space of the enclosure 80 is maintained to be lower than the predetermined threshold.

In step S600, the conveyed print medium passes through the decurling roller 83 and the occurred curl is corrected. In step S700, the print medium whose curl has been corrected is discharged outside the apparatus.

Therefore, according to the above-described embodiment, it is possible to make printing stand by until the humidity in the space on the downstream side of the drying acceleration unit with respect to the conveyance direction of the print medium becomes lower than the desired humidity by exhausting moist air from the space before printing on the print medium. Thus, when printing is started (restarted) and the print medium passes through the drying acceleration unit, the humidity near the conveyance path is sufficiently low, thereby preventing occurrence of curling of the print medium caused by moist air.

Second Embodiment

A delay in printing on the print medium and conveyance according to the first embodiment is particularly effective when the ink discharge amount per unit area is large over the wide range of the print medium. This embodiment will describe an example of checking, before the printing operation, the ink application density of a preceding print medium, and controlling the subsequent printing operation in accordance with a result.

Figure 13:
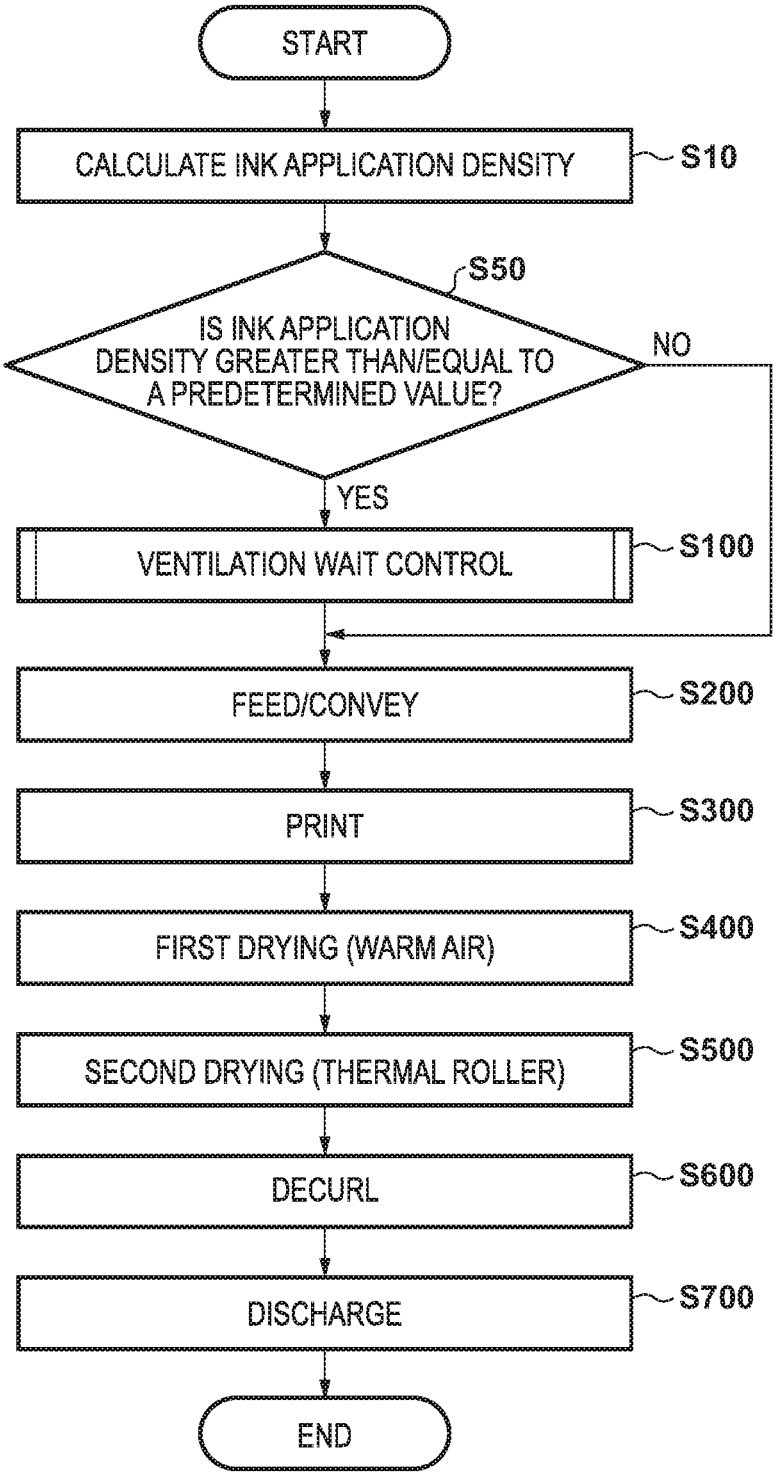
FIG. 13 is a flowchart illustrating print control according to the second embodiment.

FIG. 13 is a flowchart illustrating print control according to the second embodiment. Note that in FIG. 13, the same step numbers as those described in the first embodiment denote the same processing steps and a description thereof will be omitted. Only processes unique to this embodiment will be described.

Referring to FIG. 13, for example, if print media are continuously fed one by one to continuously perform printing, the ink discharge amount (application amount) per unit area of the print medium, which is discharged from the printheads 31 in printing on the preceding print medium, is calculated in step S10. This is calculated based on print data transferred from the host apparatus 18 to the printing system.

In step S50, it is checked whether the ink discharge amount (application amount) (DI) per unit area is equal to or larger than a predetermined value (TH2). If it is determined that the ink discharge amount (application amount) per unit area is equal to or larger than the predetermined value (DI≥TH2), the process advances to step S100, and the processes in steps S100 to S700 described in the first embodiment are executed. On the other hand, if it is determined that the ink discharge amount (application amount) per unit area is smaller than the predetermined value (DI<TH2), the process advances to step S200 by skipping step S100, and the processes in steps S200 to S700 described in the first embodiment are executed.

Therefore, according to the above-described embodiment, only if the ink discharge amount (application amount) per unit area is equal to or larger than the predetermined value, the ventilation wait control is executed. This makes it possible to execute the printing operation quickly while suppressing occurrence of curling of the print medium when the ink discharge amount (application amount) per unit area is smaller than the predetermined value.

Note that even if the ink application amount per unit area on the print medium is the same, when a large amount of ink is applied (discharged) to four corners of the print medium, occurrence of curling is encouraged. Therefore, in the processes in steps S10 and S50, it is preferable to calculate the ink discharge amount (application amount) for each area of the print medium, and make determination using a different value.

Third Embodiment

In the first and second embodiments, the hygro-sensor 81 actually measures the humidity in the internal space of the enclosure 80, and print control is executed based on a result. This embodiment will describe an example of estimating, based on a print history, a time until the humidity of moist air becomes lower than a desired value by ventilation, and performing ventilation by making the printing operation stand by based on the estimation result.

Figure 14:
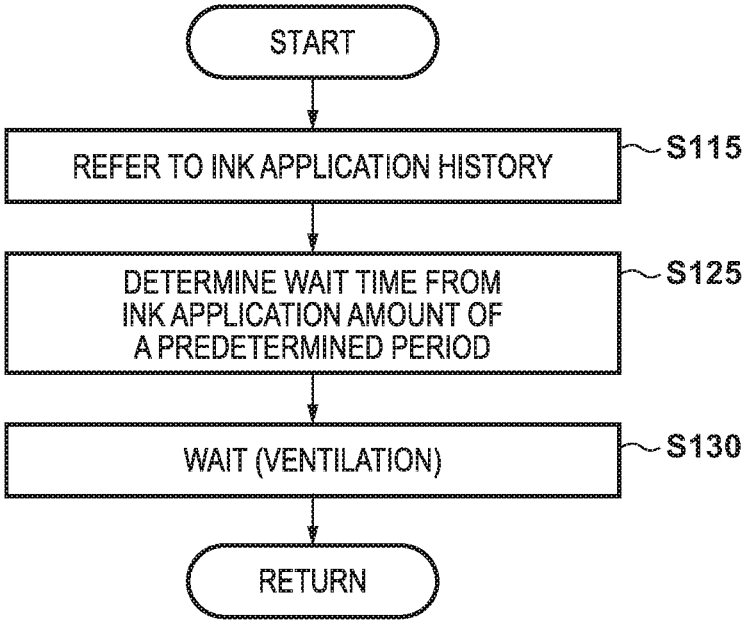
FIG. 14 is a flowchart illustrating details of ventilation control included in the print control shown in FIG. 11 according to the third embodiment.

FIG. 14 is a flowchart illustrating details of the ventilation wait control included in the print control shown in FIG. 11. Therefore, in this embodiment, the overall print control executes the processing shown in FIG. 11, and executes the processing shown in FIG. 14 instead of the ventilation wait control shown in FIG. 12. Note that in this embodiment, the hygro-sensor in the enclosure 80 shown in FIG. 10 is not required but the environmental humidity can be input from a hygrometer provided in a location where the printing system 1 is installed. The environmental humidity may be input manually by the user from the operation unit 7, or if the hygrometer includes a digital output interface, humidity information may be input via the interface (I/F) 12.

The storage unit 11 of the control unit 9 stores, for each page of the print medium, the history (ink application amount history and print history) of an ink amount discharged from the printheads 31 by printing until now. Then, at the end of printing on each page, the print end time is also stored.

Referring to FIG. 14, in step S115, the CPU of the processing unit 10 accesses the storage unit 11 to read out the ink application history and refer to it. Note that in this embodiment, an air volume as the ventilation capability of the fan 82 is 0.5 $m^3$/min, and the internal volume of the enclosure 80 is 0.025 $m^3$. In this case, if the flow of ventilation is ideal without stagnation, the outside air can be ventilated in 3 sec. Thus, as the print history, information for 3 sec ideally suffices. However, since stagnation actually occurs in the flow of ventilation, the influence of a rise in humidity is predicted based on the print history for several ten sec. Note that the ventilation capability of the fan 82 and the internal volume of the enclosure 80 are not limited to the above-described values, and other values may be possible.

Then, in step S125, based on the print history stored in the storage unit 11, the sum of the ink discharge amounts (ink application amounts) of pages printed within a most recent predetermined time (for example, several ten sec) is calculated. Note that if more accurate humidity estimation is performed, values each obtained by multiplying the ink discharge amount by a coefficient for attenuating the humidity contribution influence in accordance with an elapsed time from the end of printing to the most recent time may be summed. For example, a coefficient of 1 is set for an elapsed time (Telps) less than 5 sec (Telps<5), a coefficient of 0.1 is set for an elapsed time of 5 sec (inclusive) to 10 sec (exclusive) (5≤Telps<10), and a coefficient of 0.01 is set for an elapsed time of 10 sec (inclusive) to 15 sec (exclusive) (10≤Telps<15). In this example, assuming that the influence is negligible when the elapsed time is 15 sec or longer (Telps≥15), processing of deleting the value from the print history is performed or calculation is performed using a coefficient of 0.

As described above, a time required for the humidity to become lower than the desired value by making the printing operation stand by is estimated based on the ventilation capability of the fan 82, thereby deriving the standby time (ventilation time) of the printing operation. Then, conversion into a required ventilation time (standby time of the printing operation) is performed in accordance with the calculated sum of the ink discharge amounts (ink application amounts). The conversion processing may be performed to derive the ventilation time using a lookup table or calculate the ventilation time from simple linear calculation.

In step S130, for the converted (derived) ventilation time, the printing operation stands by and ventilation by the fan 82 is performed.

Note that the time required for ventilation need not be the time until the air in the enclosure 80 is completely replaced by the outside air, and may be the time until the humidity in the internal space becomes lower than a predetermined humidity. Furthermore, since the humidity influence of evaporation of moisture of ink after thermal fixing on the conveyance path is influenced by the humidity of the outside air, it is necessary to acquire the humidity of the outside air in addition to a rise in humidity caused by the influence of evaporation of moisture of ink after thermal fixing by the second drying acceleration unit 50. Therefore, by additionally considering the humidity information input from the external hygrometer, the required ventilation time (standby time of the printing operation) is preferably decided.

After ventilation (standby of the printing operation) in step S130, the processes in step S200 and the subsequent steps in FIG. 11 are executed, similar to the first embodiment.

Therefore, according to the above-described embodiment, it is possible to estimate the humidity based on the past print history, and decide the standby time of the printing operation based on the estimated humidity and the ventilation capability of the fan. Since a response speed is low in humidity measurement by the hygro-sensor, it is possible to implement higher-speed processing by estimating the humidity based on the past print history.

Fourth Embodiment

Each of the first to third embodiments has explained the example of printing on one surface of the print medium. An example of printing images on both surfaces of a sheet-like print medium will now be described with reference to a flowchart.

For double-sided print, an elapsed time from when a print medium is fed until printing is executed and the printed print medium is made to pass through the second drying acceleration unit 50, undergoes thermal fixing in contact with the heated roller 56, and reaches the internal space of the enclosure 80 is twice or more that for one-sided print. Therefore, it is not efficient to feed/convey a print medium and perform the ventilation wait control at a timing before the start of printing on the first surface of the print medium in order to avoid the humidity influence when the print medium reaches the conveyance path in the internal space of the enclosure 80 after thermal fixing. Thus, for double-sided print, the printing surface is inverted, and the ventilation wait control is executed immediately before the start of printing on the second surface, thereby delaying the print start timing for the second surface.

Figure 15:
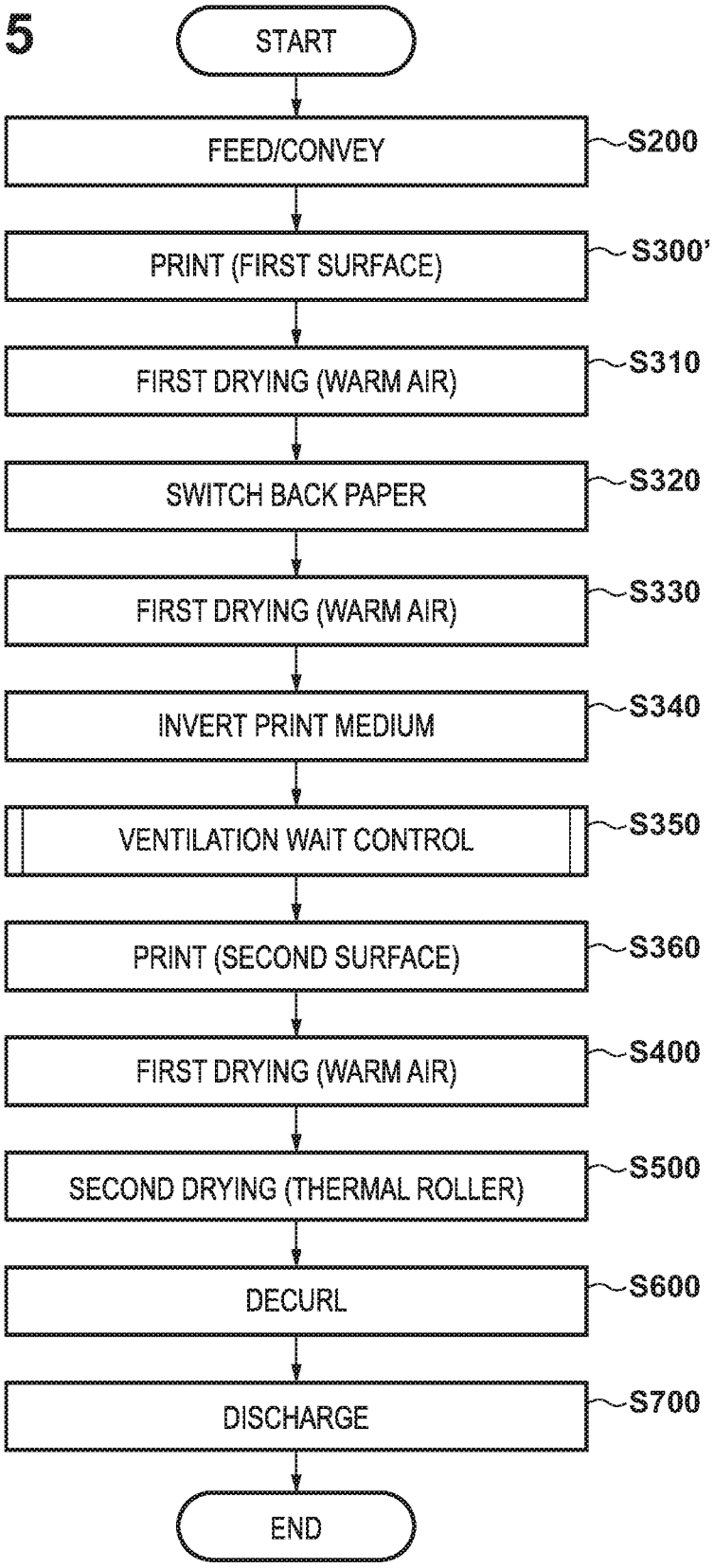
FIG. 15 is a flowchart illustrating print control for double-sided print according to the fourth embodiment.

FIG. 15 is a flowchart illustrating print control for double-sided print according to the fourth embodiment. Note that in FIG. 15, the same step numbers as those described with reference to FIG. 11 denote the same processing steps and a description thereof will be omitted. Only processes unique to this embodiment will be described.

Referring to FIG. 15, after feeding/conveying a print medium to the printheads 31 in step S200, an image is printed on one surface (first surface) of the print medium in step S300', and the print medium is further conveyed. In step S310, the fan 42 and the heating element 43 of the first drying acceleration unit 40 are driven to blow warm air from the blowing holes N, thereby drying the printing surface (first surface) of the print medium.

In step S320, the print medium is conveyed/retracted to the switch-back path RT3. In step S330, the conveyance direction of the print medium is reversed, and the print medium is made to pass through the first drying acceleration unit 40 again, and dried by warm air. In step S340, the print medium is conveyed to the inverting path RT4 to invert the printing surface of the print medium. After that, in step S350, the process executes the ventilation wait control described with reference to FIGS. 12 and 14 in the first to third embodiments. Details of the ventilation wait control have already been described in the first to third embodiments and a description thereof will be omitted.

After the end of the ventilation wait control, the process advances to step S360, and the printheads 31 print an image on the inverted printing surface (second surface) of the print medium.

Subsequent processes (steps S400 to S700) have already been described with reference to FIG. 11 in the first embodiment, and a description thereof will be omitted.

Therefore, according to the above-described embodiment, ventilation around the conveyance path of the print medium progresses during an elapsed time in a process of printing on the first surface of the print medium, drying the printing surface (first surface) by warm air, and inverting the printing surface of the print medium by reversing conveyance. Thus, even if the ventilation wait control is performed before printing on the second surface, ventilation can end within a shorter time, thereby contributing to shortening the print time.

Fifth Embodiment

This embodiment will describe an example of calculating, before printing on each of the first and second surfaces of a print medium, the ink discharge density used to print on each of the first and second surfaces and performing control based on a calculation result in addition to the control at the time of double-sided print described in the fourth embodiment.

For double-sided print, a difference in expansion between the first and second surfaces of the print medium occurs due to a difference between ink application amounts on both the surfaces. That is, even if the ink application amount on one surface is large, if the ink application amount on the other surface is equal to that amount, the expansion amounts of the surfaces of the print medium are equal to each other, and thus curling is difficult to occur. Therefore, in this embodiment, the difference in ink application amount between the first and second surfaces of the print medium is calculated before executing the ventilation wait control, and if the difference is smaller than a predetermined value, the ventilation wait control is skipped.

The features of this embodiment will be described below with reference to a flowchart.

Figure 16:
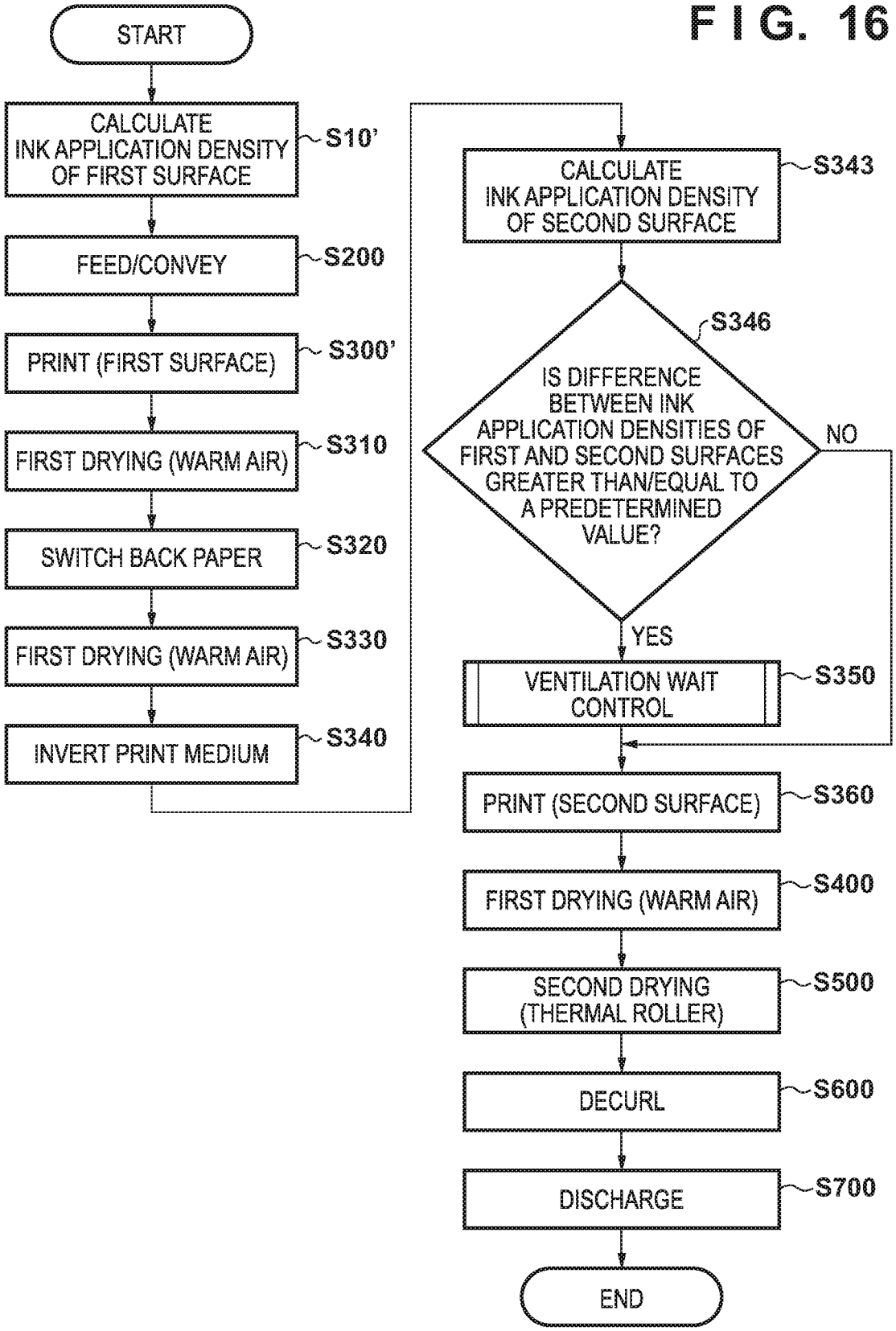
FIG. 16 is a flowchart illustrating print control for double-sided print according to the fifth embodiment.
Figure 17A:
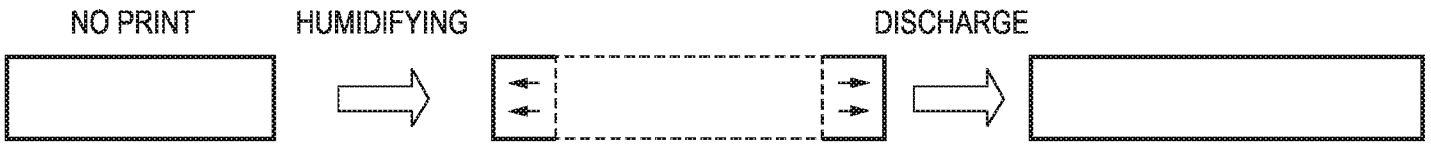
FIGS. 17A and 17B are side views of a print medium, which show a deformation state of the sheet-like print medium which has absorbed moisture.
Figure 17B:
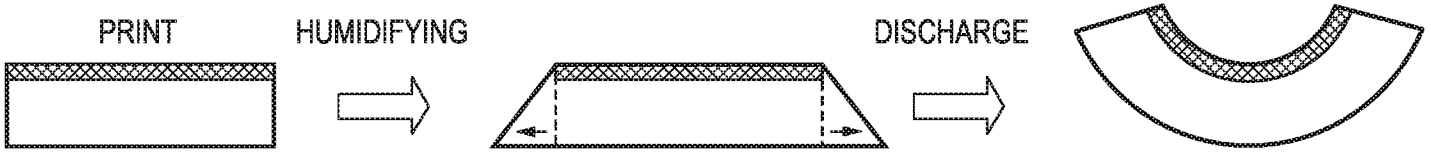

FIG. 16 is a flowchart illustrating print control for double-sided print according to the fifth embodiment. Note that in FIG. 16, the same step numbers as those described with reference to FIG. 15 denote the same processing steps and a description thereof will be omitted. Only processes unique to this embodiment will be described.

Referring to FIG. 16, in step S10', an ink application density (D1) per unit area of the print medium is calculated from an ink discharge amount discharged to the first surface of the print medium for printing based on print data received from the host apparatus 18. After that, steps S200 to S340 are executed, as described with reference to FIG. 15.

Then, in step S343, similar to step S10', an ink application density (D2) per unit area of the print medium is calculated from an ink discharge amount discharged to the second surface of the print medium for printing based on the print data received from the host apparatus 18. Next, in step S346, it is checked whether the difference between the ink application density (D1) per unit area of the first surface of the print medium and the ink application density (D2) per unit area of the second surface of the print medium is equal to or larger than a predetermined value (TH3).

If it is determined that the difference is equal to or larger than the predetermined value ($|D1-D2| \geq TH3$), the process advances to step S350, and the ventilation wait control is executed; otherwise ($|D1-D2| < TH3$), the process advances to step S360 by skipping the ventilation wait control.

Note that with respect to calculation of the difference in ink application amount between the first and second surfaces of the print medium, the difference in ink application amount for each predetermined area is desirably calculated for each pair of corresponding positions on the front and back surfaces of the print medium.

Therefore, according to the above-described embodiment, only if the difference in ink application density per unit area between the first and second surfaces of the print medium is larger than the predetermined value, the ventilation wait control is executed. Thus, it is possible to further shorten the print time depending on the print status.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-164786, filed Sep. 10, 2019, which is hereby incorporated by reference herein in its entirety.

What is claimed is:

1. A printing apparatus comprising:

a conveyance unit configured to convey a print medium fed from a feeding apparatus;

a printhead configured to print an image by discharging ink to the print medium conveyed by the conveyance unit;

a heating unit provided on a downstream side of the printhead with respect to a conveyance direction of the print medium and configured to heat the print medium;

a ventilation unit provided on a downstream side of the heating unit with respect to the conveyance direction and configured to ventilate air in a peripheral space of a conveyance path of the print medium; and a control unit configured to control to delay a start of printing by the printhead so that the print medium dried by the heating unit passes through the conveyance path in a state in which a humidity in the space becomes lower than a predetermined value due to the ventilation by the ventilation unit.

2. The apparatus according to claim 1, further comprising a measurement unit configured to measure the humidity in the space, wherein the control unit drives the ventilation unit to ventilate the air in the space based on the humidity measured by the measurement unit, and delays the start of printing until the humidity measured by the measurement unit becomes lower than a humidity threshold.

3. The apparatus according to claim 2, further comprising:

a storage unit configured to store a history of ink discharge to the print medium by the printhead; and an estimation unit configured to estimate, based on the history stored in the storage unit and a ventilation capability of the ventilation unit, a time until the humidity in the space becomes lower than the predetermined value, wherein the control unit drives the ventilation unit to ventilate the air in the space, and delays the start of printing by the time estimated by the estimation unit.

4. The apparatus according to claim 1, further comprising a calculation unit configured to calculate, before printing, an ink application amount per unit area of the print medium from an ink amount to be discharged to the print medium by the printhead based on print data received from a host apparatus, wherein if the ink application amount per unit area calculated by the calculation unit is not less than an application amount threshold, the control unit controls to delay the start of printing, and if the ink application amount is less than the application amount threshold, the control unit skips the control of delaying the start of printing.

5. The apparatus according to claim 4, further comprising:

a drying unit provided between the printhead and the heating unit with respect to the conveyance direction and configured to dry the print medium, on which the image is printed by the printhead, by blowing warm air; and an inversion unit configured to invert the print medium, wherein when printing on both surfaces of the print medium, after causing the printhead to print an image on a first surface of the print medium, causing the drying unit to dry the image on the first surface, and causing the inversion unit to invert the print medium, the control unit controls to delay a start of printing on a second surface of the print medium.

6. The apparatus according to claim 5, wherein the calculation unit includes:

a first calculation unit configured to calculate an ink application amount per unit area of the first surface; and a second calculation unit configured to calculate an ink application amount per unit area of the second surface, and if a difference between the ink application amount per unit area of the first surface calculated by the first calculation unit and the ink application amount per unit area of the second surface calculated by the second calculation unit is not less than a second application amount threshold, the control unit controls to delay the start of printing on the second surface, and if the difference is less than the second application amount threshold, the control unit skips the control of delaying the start of printing on the second surface.

7. The apparatus according to claim 6, wherein the inversion unit includes:

a first path used to reverse the conveyance direction of the print medium; and a second path used to invert a printing surface of the print medium.

8. The apparatus according to claim 1, wherein the heating unit includes:

a roller configured to heat the print medium in contact with the print medium; and a heater configured to heat the roller.

9. The apparatus according to claim 2, wherein the space in which the air is ventilated by the ventilation unit comprises an enclosure, and the measurement unit comprises a hygro-sensor provided in the enclosure.

10. The apparatus according to claim 9, wherein a decurling roller configured to decurl a curl of the print medium is provided along the conveyance path of the print medium in the enclosure.

11. The apparatus according to claim 1, further comprising a measurement unit configured to measure the humidity in the space, wherein if the humidity measured by the measurement unit is not lower than a first threshold, a time from an end of printing of a preceding print medium to a start of printing of a following print medium to be printed next is long, as compared with a case in which the humidity is lower than the humidity threshold.

12. A printing apparatus comprising:

a conveyance unit configured to convey a print medium fed from a feeding apparatus;

a printhead configured to print an image by discharging ink to the print medium conveyed by the conveyance unit;

a heating unit provided on a downstream side of the printhead with respect to a conveyance direction of the print medium and configured to heat the print medium;

a ventilation unit provided on a downstream side of the heating unit with respect to the conveyance direction and configured to ventilate air in a peripheral space of a conveyance path of the print medium; and a control unit configured to control to delay a start of conveyance by the conveyance unit so that the print medium dried by the heating unit passes through the conveyance path in a state in which a humidity in the space becomes lower than a predetermined value due to the ventilation by the ventilation unit.

13. The apparatus according to claim 12, further comprising a measurement unit configured to measure the humidity in the space, wherein if the humidity measured by the measurement unit is not lower than a humidity threshold, a time from an end of printing of a preceding print medium to a start of conveyance of a following print medium to be printed next is long, as compared with a case in which the humidity is lower than the first threshold.

14. A control method for a printing apparatus including a conveyance unit configured to convey a print medium fed from a feeding apparatus, a printhead configured to print an image by discharging ink to the print medium conveyed by the conveyance unit, a heating unit provided on a downstream side of the printhead with respect to a conveyance direction of the print medium and configured to heat the print medium, and a ventilation unit provided on a downstream side of the heating unit with respect to the conveyance direction and configured to ventilate air in a peripheral space of a conveyance path of the print medium, the method comprising:

controlling to delay a start of printing by the printhead so that the print medium dried by the heating unit passes through the conveyance path in a state in which a humidity in the space becomes lower than a predetermined value due to the ventilation by the ventilation unit.

15. The method according to claim 14, further comprising measuring the humidity in the space, wherein in the controlling, the ventilation unit is driven to ventilate the air in the space based on the measured humidity, and the start of printing is delayed until the measured humidity becomes lower than a humidity threshold.

16. The method according to claim 15, further comprising:

storing, in a memory, a history of ink discharge to the print medium by the printhead; and estimating, based on the history stored in the memory and a ventilation capability of the ventilation unit, a time until the humidity in the space becomes lower than the predetermined value, wherein in the controlling, the ventilation unit is driven to ventilate the air in the space, and the start of printing is delayed by the estimated time.

17. The method according to claim 14, further comprising calculating, before printing by the printhead, an ink application amount per unit area of the print medium from an ink amount to be discharged to the print medium based on print data received from a host apparatus, wherein in the controlling, if the calculated ink application amount per unit area is not less than an application amount threshold, control is executed to delay the start of printing, and if the calculated ink application amount is less than the application amount threshold, the control of delaying the start of printing is skipped.

18. The method according to claim 17, further comprising drying the print medium, on which the image is printed by the printhead, by blowing warm air between the printhead and the heating unit with respect to the conveyance direction, wherein when printing on both surfaces of the print medium, after causing the printhead to print an image on a first surface of the print medium, drying the image on the first surface, and inverting a front and back of the print medium, control is executed, in the controlling, to delay a start of printing on the second surface of the print medium.

19. The method according to claim 18, wherein in the calculating, an ink application amount per unit area of the first surface is calculated, and an ink application amount per unit area of the second surface is calculated, and in the controlling, if a difference between the calculated ink application amount per unit area of the first surface and the calculated ink application amount per unit area of the second surface is not less than a second application amount threshold, control is executed to delay the start of printing on the second surface, and if the difference is less than the second application amount threshold, the control of delaying the start of printing on the second surface is skipped.

20. The method according to claim 19, wherein in the inverting, a first path is used to reverse the conveyance direction, and a second path is used to invert a printing surface of the print medium.

* * * * *